US006485132B1

(12) United States Patent
Hiroki et al.

(10) Patent No.: US 6,485,132 B1
(45) Date of Patent: Nov. 26, 2002

(54) LIQUID DISCHARGE HEAD, RECORDING APPARATUS, AND METHOD FOR MANUFACTURING LIQUID DISCHARGE HEADS

(75) Inventors: Tomoyuki Hiroki, Zama; Masahiko Ogawa, Hino; Masami Ikeda, Tokyo; Ichiro Saito, Yokohama; Hiroyuki Ishinaga, Tokyo; Yoshiyuki Imanaka, Kawasaki; Teruo Ozaki, Yokohama; Masahiko Kubota, Tokyo; Takayuki Yagi, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/206,281

(22) Filed: Dec. 7, 1998

(30) Foreign Application Priority Data

| | | |
|---|---|---|
| Dec. 5, 1997 | (JP) | 9-336055 |
| Dec. 5, 1997 | (JP) | 9-336057 |
| Dec. 5, 1997 | (JP) | 9-336058 |
| Dec. 5, 1997 | (JP) | 9-336103 |
| Apr. 16, 1998 | (JP) | 10-106299 |
| Oct. 26, 1998 | (JP) | 10-304510 |
| Dec. 4, 1998 | (JP) | 10-346076 |

(51) Int. Cl.[7] ..... B41J 2/05
(52) U.S. Cl. ..... 347/65
(58) Field of Search ..... 347/65, 54, 56, 347/63, 64, 57, 58, 59; 29/290.1; 430/320; 216/27; 438/21

(56) References Cited

U.S. PATENT DOCUMENTS

| | | | | |
|---|---|---|---|---|
| 4,251,824 A | | 2/1981 | Hara et al. | 347/57 |
| 4,611,219 A | | 9/1986 | Sugitani et al. | 347/40 |
| 4,680,859 A | * | 7/1987 | Johnson | 29/611 |

(List continued on next page.)

FOREIGN PATENT DOCUMENTS

| | | | | |
|---|---|---|---|---|
| EP | 0 178 596 | | 4/1986 | |
| EP | 0 500 110 | | 8/1992 | |
| EP | 0 674 995 | | 10/1995 | |
| EP | 745479 | * | 4/1996 | |
| EP | 0 737 582 | | 10/1996 | |
| EP | 0 778 133 | | 6/1997 | |
| JP | 6-261453 | | 11/1987 | |
| JP | 6-31918 | | 2/1994 | |
| JP | 9-226135 | * | 9/1997 | B41J/2/01 |

OTHER PUBLICATIONS

Micromachined Transducers Sourcebook, 1998, The McGraw–Hill Companies, pp. 290–292, 825.*

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A liquid discharge head includes a pair of substrates mutually fixed in lamination, a plurality of liquid flow paths arranged on the bonded faces of the substrates, the leading end of the plural liquid flow paths being communicated with a plurality of discharge ports, a plurality of heat generating members arranged on at least one of the substrates corresponding to each of the liquid flow paths and a movable member having in the liquid flow path the free end thereof on the discharge port side, and a region between the heat generating member and the movable member, where liquid exists. In the liquid discharge head, a bubble is created by enabling thermal energy generated by the heat generating members to act upon the liquid, and the bubble is controlled by the movable member to discharge liquid in the liquid flow paths from the discharge ports to the outside. Further, all of the movable members, members becoming side walls of liquid flow paths, members supporting the movable members, and members supporting the walls of liquid flow paths are formed by materials containing silicon and the side walls of liquid flow paths are formed by patterning the material containing silicon formed on the surface of one of the pair of substrates in the liquid discharge head.

24 Claims, 25 Drawing Sheets

U.S. PATENT DOCUMENTS

| | | | | | |
|---|---|---|---|---|---|
| 4,723,129 | A | | 2/1988 | Endo et al. | 347/56 |
| 4,890,126 | A | | 12/1989 | Hotomi | 347/45 |
| 4,947,192 | A | * | 8/1990 | Hawkins et al. | 347/59 |
| 4,990,939 | A | | 2/1991 | Sekiya et al. | 347/62 |
| 5,172,139 | A | | 12/1992 | Sekiya et al. | 347/15 |
| 5,278,585 | A | | 1/1994 | Karz et al. | 347/65 |
| 5,479,197 | A | | 12/1995 | Fujikawa et al. | 347/63 |
| 5,580,468 | A | | 12/1996 | Fujikawa et al. | 216/27 |
| 5,602,576 | A | | 2/1997 | Murooka et al. | 347/59 |
| 5,825,385 | A | * | 10/1998 | Silverbrook | 347/56 |
| 5,924,197 | A | * | 7/1999 | Murakami et al. | 29/890.1 |
| 5,943,074 | A | * | 8/1999 | Kashino et al. | 347/54 |
| 6,071,750 | A | * | 6/2000 | Silverbrook | 438/21 |

* cited by examiner

LIQUID DISCHARGE HEAD, RECORDING APPARATUS, AND METHOD FOR MANUFACTURING LIQUID DISCHARGE HEADS

BACKGROUND OF THE INVENTION

1. Field of the Invention

The present invention relates to a liquid discharge head used for a printer, a video printer, and the like adopted as the output terminal of a copying machine, a facsimile equipment, a word processor, a host computer, and the like. The invention also relates to a method for manufacturing liquid discharge heads, and to a recording apparatus. More particularly, the invention relates to the liquid discharge head provided with the substrate having heat generating members (electrothermal converting elements) formed on it to generate thermal energy as the liquid discharge energy, and to discharge recording liquid (ink or the like) from the discharge ports (discharge openings) as flying droplets which are caused to adhere to a recording medium. The invention also relates to the recording apparatus using such head.

Here, the term "recording" referred to in the specification hereof not only means the formation of meaningful images, such as characters and graphics, recorded on a recording medium, but also, means the formation of images, such as patterns, which do not present any particular meaning.

2. Related Background Art

Conventionally, the so-called ink jet recording method performs recording by use of a liquid discharge head is of non-impact type, which generates less noise, while making a highly densified printing possible at higher speeds. Besides, it is comparatively easy to maintain such recording method. There is also a good possibility that this method is executable maintenance-free. For such advantages and reasons as described above, the ink jet recording method has been widely adopted in recent years.

Of the ink jet recording methods, there has been known the bubble jet recording method, in which ink is caused to foam by the application of heat to discharge ink from the discharge ports (discharge openings), hence forming images on a recording medium with the adhesion of ink to it. For the recording apparatus that executes this bubble jet recording method, there are provided discharge ports (discharge openings) that discharge ink; liquid flow paths communicated with the discharge ports; heat generating members (electrothermal converting members or the like) that generate energy for causing ink in the liquid flow paths to be discharged as has been disclosed in the specification of U.S. Pat. No. 4,723,129. With a recording apparatus of the kind, it becomes possible to record high-quality images at higher speeds, with less noise as described above. At the same time, it is possible to arrange the discharge ports in higher density. Therefore, this kind of recording apparatus has an advantage, among many others, that images can be recorded in high resolution with a smaller apparatus, and images are easily obtainable in colors. As a result, the bubble jet recording method is utilized for office equipment, such as a printer, a copying machine, and facsimile equipment. Further, it is widely utilized for the industrial use, such as textile printing system, among others.

The general structure of the liquid discharge head used for a recording apparatus of this kind is to arrange the substrate having a plurality of liquid flow paths formed on it, and the other substrate having a plurality of heat generating members on it, hence enabling the groove formation surface and the arrangement surface of the heat generating members to be positioned to face each other and fix them in a laminated state. Each of the heat generating members is then allowed to fit with each of the liquid flow paths, respectively. Further, on the end faces of the substrates arranged in the laminated state, the discharge port plate (discharge port formation member) is fixed. Then, a plurality of discharge ports arranged for the discharge port plate are communicated with the leading end of the liquid flow paths, respectively.

Also, there is a case where the end face of the substrate is arranged integrally as one body so it may be drilled for the provision of the discharge ports without preparing the discharge port formation member separately.

In recent years, it has been required that a liquid discharge head of the kind should be able to print highly precise images at higher speeds. To meet such a requirement, the applicant hereof has proposed the structure that provides a movable member that controls bubbles in each of the liquid flow paths to guide bubbles to the discharge port side, as disclosed in Japanese Patent Application Laid-Open No. 6-31918. With the formation of this structure, it is anticipated that the discharge efficiency and the refilling characteristics are enhanced significantly.

Now, for the structure disclosed in the specification of the above mentioned Laid-Open Application, which has a movable member in each liquid flow path, it is extremely important to secure the close contact and the accuracy of the relative positions between a pair of substrates and each of the movable members, as well as the walls of the liquid flow paths. In other words, since the arrangement density of the liquid flow paths becomes very high in order to obtain highly precise images in recent years, the clearance obtainable for each of the movable members and the walls of liquid flow paths becomes smaller still, and in the worst case, the operation of the movable members may become imperfect if the positional precision is not good enough. Also, if the close contact and the accuracy of the relative positions are unfavorable, ink leakage may take place that stains the interior of the apparatus. As a result, there is a fear that such ink leakage even causes a short circuit between electric conductors in some cases. Also, the ink supply to the discharge ports may become insecure, which causes a shortage of ink to be discharged in some cases.

For the conventional structure described above, if the pair of substrates, the movable members, and the walls of the liquid flow paths are formed by different materials, there is a fear that the positional deviation takes place or the close contactness is affected due to the difference in the expansion coefficients of materials along with the temperature changes in operation that may cause the thermal expansion of the substrates and discharge port formation member even though the assembly is made with case in good precision when the head is manufactured.

For the head having the movable members in the liquid flow paths as described above, the warping and positional deviation of substrates, as brought about by the difference in the thermal expansion coefficient, may impede the normal operation of the movable members. Therefore, it is required for such a head to secure the higher positional precision than the conventional ink jet head, which is not provided with the movable members.

The inventors hereof, therefore, have devised the prevention of the defective operation of the movable members by reducing the difference in the thermal expansion coefficient of each of the members with the provision of the one and the same element to be contained in the movable members and the walls of the liquid flow paths, and the members that fix the movable members, as well as in the members that fix the walls of the liquid flow paths.

In this respect, meanwhile, there is the U.S. Patent of the Xerox application for such a technology as described above. However, in accordance with the Xerox application, the walls of liquid flow paths are provided by the performance of the anisotropic etching of the ceiling plate whose surface has the (100) plane of silicon crystal axes. However, with the structure thus disclosed, it is impossible to enhance the density of arrangement as required, because the section of each liquid flow path is made in the triangular form.

Further, if the silicon substrate whose surface has the (110) plane of crystal axes should be anisotropically etched, there is a problem that the resistance to ink of the walls of the liquid flow paths is lowered as compared with the (100) plane of the crystal axes, even if the section of each liquid flow path is formed square.

SUMMARY OF THE INVENTION

Therefore, it is an object of the present invention to provide a liquid discharge head capable of maintaining the higher quality printing and the stable discharges without causing any considerable changes in the flow path resistance, the close contactness between substrates, and the relative positional accuracy even if temperatures are changed along with the high speed printing or the like. It is also the object of the invention to provide a method for manufacturing such head, and a recording apparatus using it.

In order to achieve this objective, the present invention is characterized in the provision of a liquid discharge head which comprises a pair of substrates fixed in lamination; a plurality of liquid flow paths arranged on the bonded faces of the substrates, the leading end of the plural liquid flow paths being communicated with a plurality of discharge ports; a plurality of heat generating members arranged on at least one of the substrates corresponding to each of the liquid flow paths; and movable members each having in the liquid flow path the free end thereof on the discharge port side, and a region between each of the heat generating members and the movable members having liquid residing thereon. Then, bubbles are created by enabling thermal energy generated by the heat generating members to act upon the liquid, and controlled by the movable members to discharge liquid in the liquid flow paths from the discharge ports to the outside. For this liquid discharge head, the movable members, members becoming side walls of liquid flow paths, members supporting the movable members, and members supporting the walls of liquid flow paths are all formed by materials containing silicon, and at the same time, the side walls of liquid flow paths are provided by patterning the material containing silicon formed on the surface of one of the pair of substrates. In this manner, the thermal expansion coefficients of the substrates and the discharge ports are substantially made equal to prevent the close contactness between the respective members from being lowered, and also prevent the relative positions between them from being deviated.

Further, if the structure is arranged so that the pair of substrates are bonded by the surface activation bonding at the room temperature, it is possible to prevent the dipping of bonding agent into the liquid flow paths.

It is also preferable to use silicon nitride or some other inorganic material for the materials that contain silicon, because such material has excellent resistance to solvent.

The recording apparatus of the present invention is provided with a liquid discharge head which has either one of the structures described above.

Also, in order to achieve the above-mentioned objective, the method of the present invention for manufacturing a liquid discharge head, which is provided with a pair of substrates fixed in lamination; a plurality of liquid flow paths arranged on the bonded faces of the substrates, the leading end of the plural liquid flow paths being communicated with a plurality of discharge ports; a plurality of heat generating members arranged on at least one of the substrates corresponding to each of the liquid flow paths; and movable members each having in the liquid flow path the free end thereof on the discharge port side, and a region between each of the heat generating members and the movable members having liquid residing thereon, and then, bubbles are created by enabling thermal energy generated by the heat generating members to act upon the liquid, and controlled by the movable members to discharge liquid in the liquid flow paths from the discharge ports to the outside, comprises the steps of forming all of the movable members, members becoming side walls of liquid flow paths, members supporting the movable members, and members supporting the walls of liquid flow paths by materials containing silicon; and forming the flow path side walls simultaneously by patterning the material containing silicon formed on the surface of either one of the substrate as film subsequent to the formation of this film on it.

Further, the method for manufacturing a liquid discharge head comprises the step of providing movable members each having its free end in the discharge port side in each of the liquid flow paths, and also, a region where liquid resides between the movable member and each of the heat generating members. Here, the movable members are formed by material containing silicon, and also, the step in which the movable members are provided is the step of bonding the movable members at least to one of the paired substrates at the room temperature.

BRIEF DESCRIPTION OF THE DRAWINGS

FIG. 22A shows the manufacture process of the silicon ceiling plate formed integrally with the orifices; FIG. 22B shows the processes up to the orifice portion has been processed.

FIG. 23A shows the manufacture process of the flow path portion; FIG. 23B shows the processes up to the orifice portion has been processed.

DETAILED DESCRIPTION OF THE PREFERRED EMBODIMENTS

Hereinafter, in conjunction with the accompanying drawings, the detailed description will be made of the present invention.

(First Embodiment)

Figure 1:
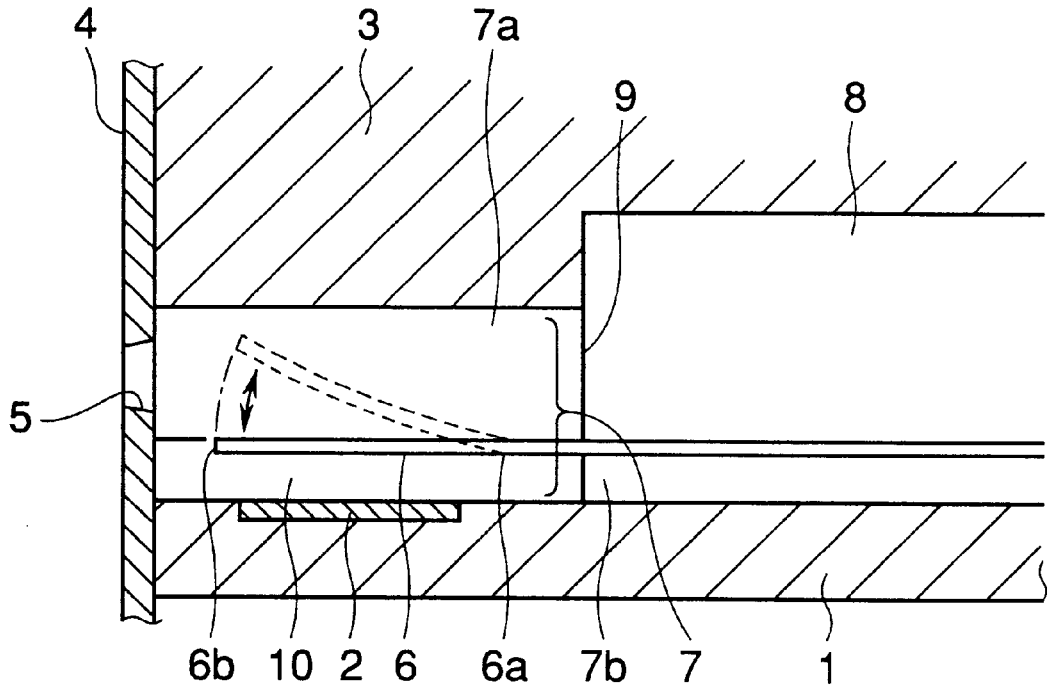
FIG. 1 is a cross-sectional view which illustrates the principal part of the fundamental structure of a liquid discharge head taken in the direction of the liquid flow paths in accordance with a first embodiment of the present invention.

FIG. 1 is a cross-sectional view taken in the flow path direction, which illustrates the fundamental structure of a liquid discharge head in accordance with a first embodiment of the present invention.

As shown in FIG. 1, the liquid discharge head is provided with an element substrate (one substrate) 1 having a plurality of heat generating members (driving elements) 2 (only one of them is shown in FIG. 1) arranged on it to give thermal energy for the creation of bubbles in liquid, and also, with a ceiling plate (the other substrate) 3 which is bonded onto the element substrate 1. In accordance with the present embodiment, both the element substrate 1 and the ceiling plate 3 are formed by material containing silicon so that its thermal expansion coefficients are made substantially equal.

The element substrate 1 is produced by patterning the electrically resistive layer that forms the heat generating members 2 and the wiring on a silicon substrate. Voltage is applied to the electrically resistive layer through the wiring to cause each of the heat generating members 2 to generate heat by the current running thereon. The structures of the element substrate 1 and the heat generating member 2 will be described later in detail.

The ceiling plate 3 forms a plurality of liquid flow paths 7 corresponding to each of the heat generating members 2, and the common liquid chamber 8 from which liquid is supplied to each of the liquid flow paths 7. Then, the side walls 9 of the liquid flow paths are integrally formed to extend from the ceiling portion to each portion between the heat generating members 2. It is possible to form the ceiling plate 3 by depositing the layer of silicon nitride, silicon carbide, or the like, which becomes the side walls 9 of the liquid flow paths as described later, by the known film formation method, such as CVD (Chemical Vapor Deposition) or sputtering, and then, by etching (patterning) the portion of the liquid flow paths 7 on the ceiling plate. In this way, the side walls of the liquid flow paths are formed, and the sectional configuration of each liquid flow path is made square. At the same time, it becomes possible to make resistance to ink itself favorable for the walls of the liquid flow paths. For the ceiling plate 3, the supply opening 11 (see FIGS. 7A to 7D) and the common liquid chamber 8 are provided in the same method as has been applied to the formation of the liquid flow paths 7. The rear end of each liquid flow path 7 is connected with the common liquid chamber 8. Liquid is supplied from the supply opening 11 to each of the liquid flow paths 7 through the common liquid chamber 8. Further, each leading end of the liquid flow paths 7 becomes the discharge port 5. Each of the discharge ports 5 are formed on the discharge port plate 4 which serves as the discharge port formation member. The discharge port plate 4 is also formed by silicon material. For example, the silicon substrate having the discharge ports 5 formed on it is cut to a thickness of approximately 10 to 150 um for the formation of this plate. Here, however, the discharge port plate 4 is not necessarily a constituent of the present invention. In stead of the provision of the discharge port plate 4, it may be possible to leave a wall portion equivalent to the thickness of the discharge port plate 4 on the leading end face of the ceiling plate 3 when the liquid flow paths 7 are formed on the ceiling plate 3, hence arranging this portion thus left intact to be the discharge port formation member. Then, the discharge ports 5 are formed on this discharge port formation member. Then, it becomes possible to form a ceiling plate together with the discharge ports in this manner.

The discharge ports 5 are drilled by the application of ion beam processing (processed in vacuum), excimer laser process, or etching (dry etching or wet etching), among some other methods.

For the liquid discharge head, there is provided each of the movable member 6 in the cantilever fashion to face each heat generating member 2 in each liquid flow path 7. The movable member 6 is a thin film formed by silicon material, such as silicon nitride or silicon carbide, and laminated on another substrate (not shown). After that, it is peeled off from such substrate and positioned exactly above each heat generating member 2 on the element substrate 1, and then, fixed. Also, the movable member may be formed by the direct formation of the thin film on the element substrate 1. In this case, however, it is necessary to perform an additional process for the formation of a gap above each of the heat generating members 2.

The movable member 6 has its fulcrum 6*a* on the upstream side of a large flow running from the common liquid chamber 8 to the discharge port 5 side through the movable member 6 by the discharge operation of liquid. Then, the movable member 6 is arranged in a position to face the heat generating member 2 with a specific distance from the heat generating member 2 in a state to cover the heat generating member 2 so that the movable member 6 has its fee end on the downstream side of the fulcrum 6*a*. There is arranged each of the bubble generating areas 10 between each of the heat generating members 2 and the movable members 6.

Figure 2:
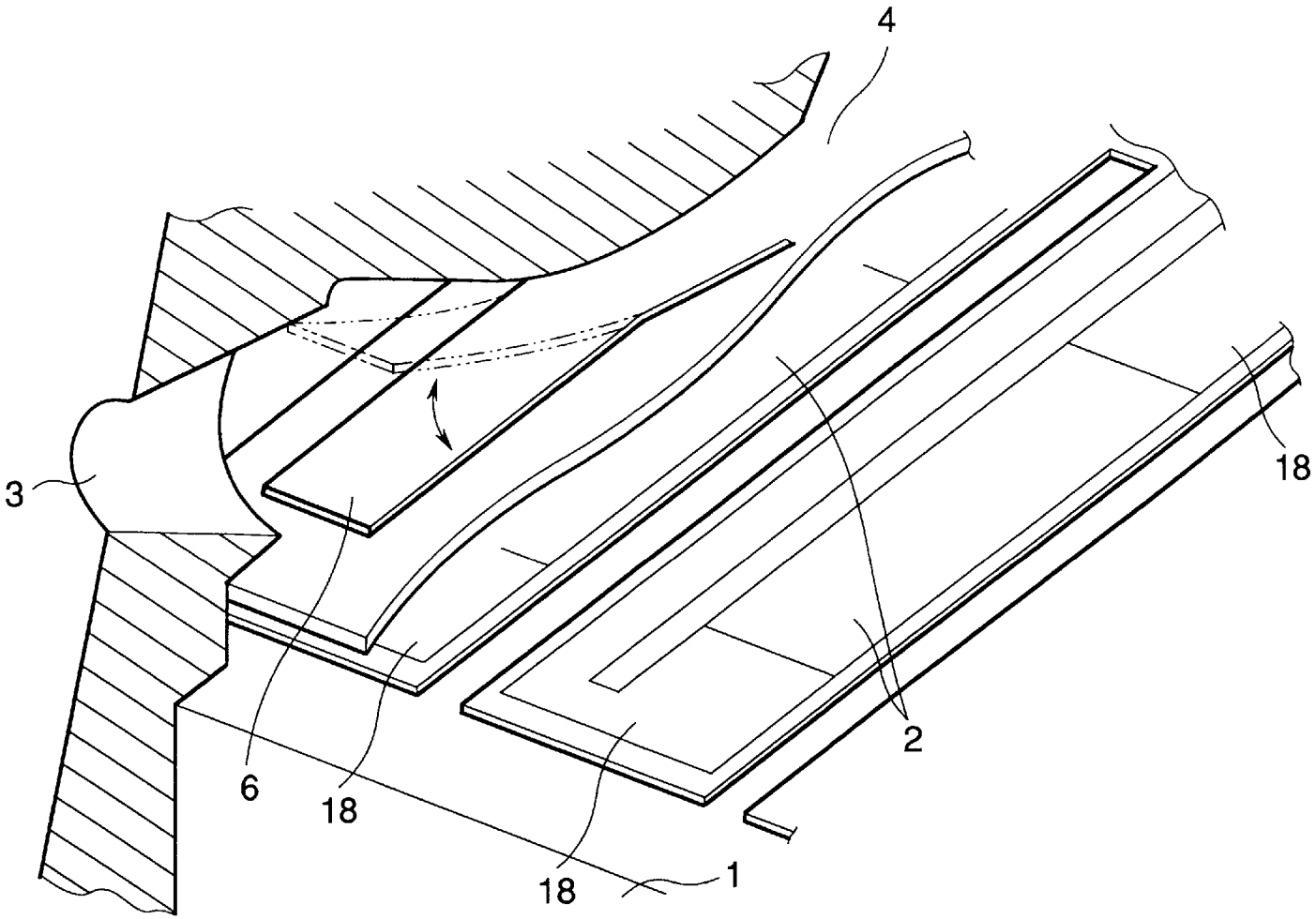
FIG. 2 is an enlarged perspective view which shows the mounting portion of the movable members in accordance with the first embodiment.

As shown in FIG. 2, there is arranged for the liquid discharge head of the present embodiment, a separation wall 4 formed by an elastic material, such as an inorganic thin film, on the substrate 1 having the heat generating member 2 provided therefor to give thermal energy, and by means of bubbles created on the heat generating member 2, this separation wall repeats its vertical vibrations. The leading end of the separation wall 4, that is, the portion which is positioned in the vertically projected space in the plane direction of the heat generating member, becomes the movable member 6 formed in the cantilever fashion as described earlier. Thus, the movable member 6 is arranged to face the bubble generating area (the surface of the heat generating 2) 10. On the element substrate 1, on which each of the heat generating members 2 (electrothermal transducing devices) and the wiring electrodes 18 which apply electric signals to the electrothermal transducing devices are arranged, each of the movable members 6 is fixed on the pedestal installed in the common liquid chamber so as to be extended into the space that forms each of the liquid flow paths 7.

In this way, the element substrate 1, the ceiling plate 3, and the movable members 6 are positioned exactly, and the assembling is made so that each of the liquid flow paths 7, the heat generating members 6, the discharge ports 5 are positioned corresponding to each other.

Now, hereunder, the operation of the present embodiment will be described.

When the heat generating member 2 in the liquid flow path 7 is driven to generate heat, the liquid residing in the bubble generating area 10 between the movable member 6 and the heat generating 2 is activated by heat so that bubble is created on the heat generating member 2 by means of film boiling phenomenon. This bubble is developed. Then, the pressure exerted along with the development of the bubble acts upon the movable member 6 priorly, and as indicated by broken line in FIG. 1, the movable member 6 is displaced to open largely to the discharge port 5 side centering on the fulcrum 6*a*. By the displacement of the movable member 6 or by the displacement condition thereof, the propagation of pressure exerted by the creation of bubble, and the development of the bubble itself are guided to the discharge port 5 side. Thus, the liquid is pushed out from the discharge port 5 and discharged.

In other words, with the arrangement of each movable member 6 on the bubble generating area 10, which is provided with the fulcrum 6*a* on the upstream side (the common liquid chamber 8 side) and the free end 6*b* on the downstream side (the discharge port 5 side) in the flow of liquid in each liquid flow path 7, the pressure of each bubble directly contributes to performing discharges efficiently. The bubble development itself is also directed to the downstream side as the pressure propagation is thus directed, making it possible to develop the bubble larger in the downstream than the upstream. In this manner, the bubble development direction itself is controlled by means of the movable member 6, thus controlling the direction of the bubble pressure propagation as well. Then, it is made possible to enhance the fundamental characteristics of discharges, such as the discharge efficiency and discharge power or the discharge speeds, among some others. In other words, it becomes possible to concentrate the energy generated by each of the heat generating members 2 in the discharge direction efficiently for the execution of higher recording operation.

On the other hand, when the bubble enters its bubble-disappearing state, the bubble is rapidly defoamed by the multiplier effect of the elasticity of the movable member 6. Then, the movable member 6 returns lastly to the initial position indicated by solid line in FIG. 1. At this juncture, in order to complement the contracted volume of the bubble on the bubble generating area 10, and also, to complement the voluminal portion of liquid that has been discharged, liquid is allowed to flow in from the upstream side, that is, from the common liquid chamber 8 side, to refill it in the corresponding liquid flow path 7. This refilling of liquid is performed efficiently, rationally, and stably along with the returning operation of each of the movable members 6.

Figure 3:
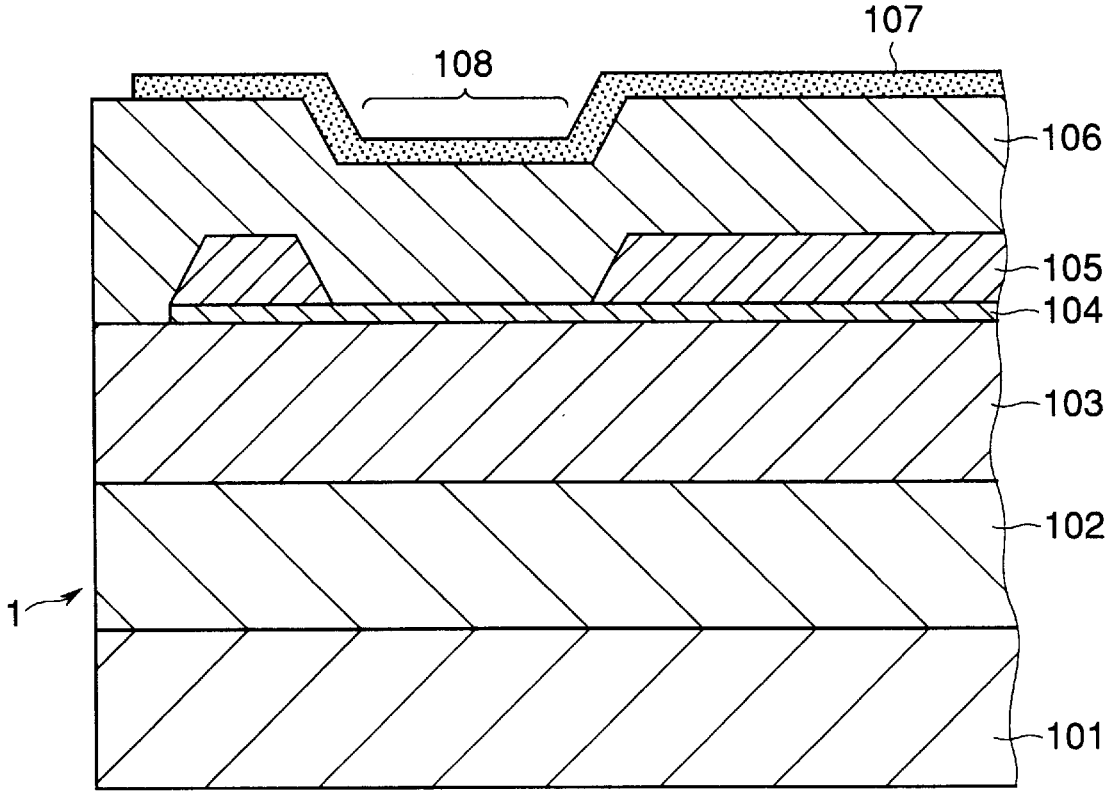
FIG. 3 is an enlarged sectional view which shows the element substrate in accordance with the first embodiment.

Now, with reference to FIG. 3 and FIG. 4, the detailed description will be made of the element substrate 1 of the liquid discharge head. FIG. 3 is a cross-sectional view which shows the portion corresponding to the portion (bubble generating area) of the heat generating member 2 of the element substrate 1.

At first, there are laminated on the silicon substrate 101, the thermal oxidation film 102 which serves as the heat accumulation layer, and the interlayer film 103 formed by silicon oxide ($SiO_2$) or silicon nitride ($Si_3N_4$), which dually functions as the heat accumulation layer. Then, the resistive layer 104, and the Al alloy wiring 105 formed by Al or Al—Si, Al—Cu, or the like are patterned, respectively. On this layer, there are laminated the protection film 106, which is also formed by silicon oxide ($SiO_2$) or silicon nitride ($Si_3N_4$), and the cavitation proof film 107 which protects the protection film 106 from the chemical and physical shocks following the heat generation of the resistive layer 104. Here, the area where wiring 105 is not formed becomes the thermal activation portion 108 of the resistive layer 104. In this way, each of the heat generating members 2 is structured by the resistive layer 104 and the thermal activation portion 108 formed on the silicon substrate.

Figure 4:
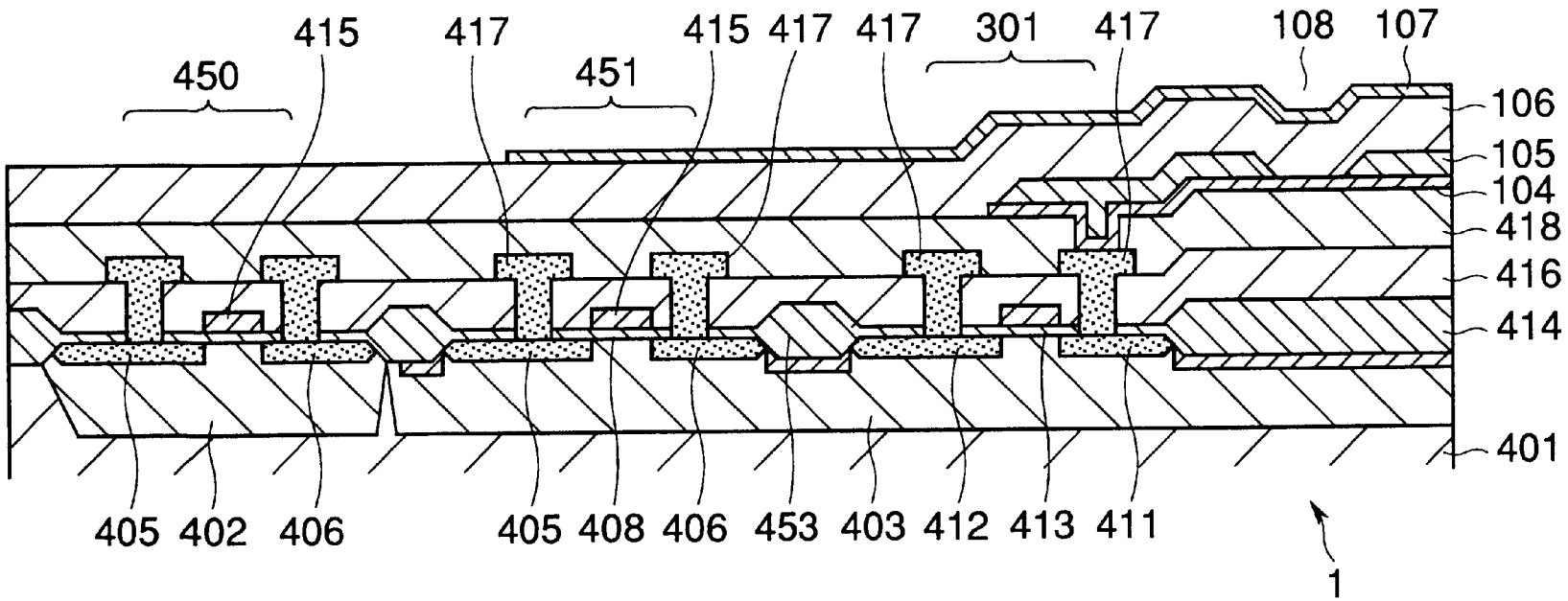
FIG. 4 is an enlarged sectional view which shows the other element substrate in accordance with the first embodiment.

FIG. 4 is a cross-sectional view schematically showing the element substrate 1 which includes this heat generating member.

Using the general MOS (Metal Oxide Silicon) process the impurity installation such as ion plantation and its diffusion are conducted to form the p-MOS on the n type well region 402 of the silicon substrate 401, which is p conductor, and the n-MOS 451 on the p type well region 403, respectively.

The p-MOS 450 and the n-MOS 451 comprise the gate wiring 415, the source region 405 where the n-type or p-type impurity is implanted, the drain region 406, and some others, which are formed by polysilicon deposited by means of the CVD method in a thickness of 4,000 Å or more and 5,000 Å or less through the gate insulation film 408 of several hundreds A, respectively. Then, the C-MOS logic is structured by these p-MOS and n-MOS.

Also, on the p-well substrate, the n-MOS transistor is arranged for use of element driving, which comprises the drain region 411, the source region 412, the gate wiring 413, and others formed also by the process of impurity installation and diffusion or the like.

Between the respective elements, the oxidized film separation region 453 is formed by means of the field oxidation in a thickness of 5,000 Å to 10,000 Å to separate each of the elements, respectively. The field oxidation film functions as the first heat accumulation layer 414 for the thermal activation portion 108.

After each of the elements is formed, there is installed the interlayer insulation film 416 formed by PSG (Phospho-Silicate Glass) film, BPSG (Boron-doped Phospho-Silicate Glass) film, or the like, prepared by the CVD method in a thickness of approximately 7,000 Å. Further, subsequent to the smoothing process or the like that has been executed by heat treatment on the interlayer insulation film 416, wiring is made through the contact hole on the first wiring layer 417 formed by the Al electrodes. Then, the interlayer insulation film 418, which is formed by SiOz film or the like prepared in a thickness of 10,000 Å to 15,000 Å, is installed by plasma CVD. Then, furthermore, the resistive layer 104, which is formed by $TaN_{0.8,hex}$ film prepared in a thickness of approximately 1,000 Å, is installed by DC sputtering method. This resistive layer 104 is partly in contact with the first wiring layer 417 by way of the through hole. After that, although not shown, the second wiring layer is formed with Al electrodes to serve as wiring to each of the heat generating members.

Subsequently, the protection film 106, which is formed by $Si_3N_4$ film prepared in a thickness of approximately 10,000 Å, is installed by plasma CVD method. Then, as the top layer, the cavitation proof film 107 is deposited with Ta or the like in a thickness of approximately 2,500 Å.

Here, for the present embodiment, the description has been made of the structure that uses the n-MOS transistor, but the present invention is not necessarily limited thereto. It may be possible to adopt any transistor if only the transistor is capable enough to drive a plurality of heat generating members individually, and also, it has the functions to enable such fine structure as described above to be formed efficiently.

Figure 8:
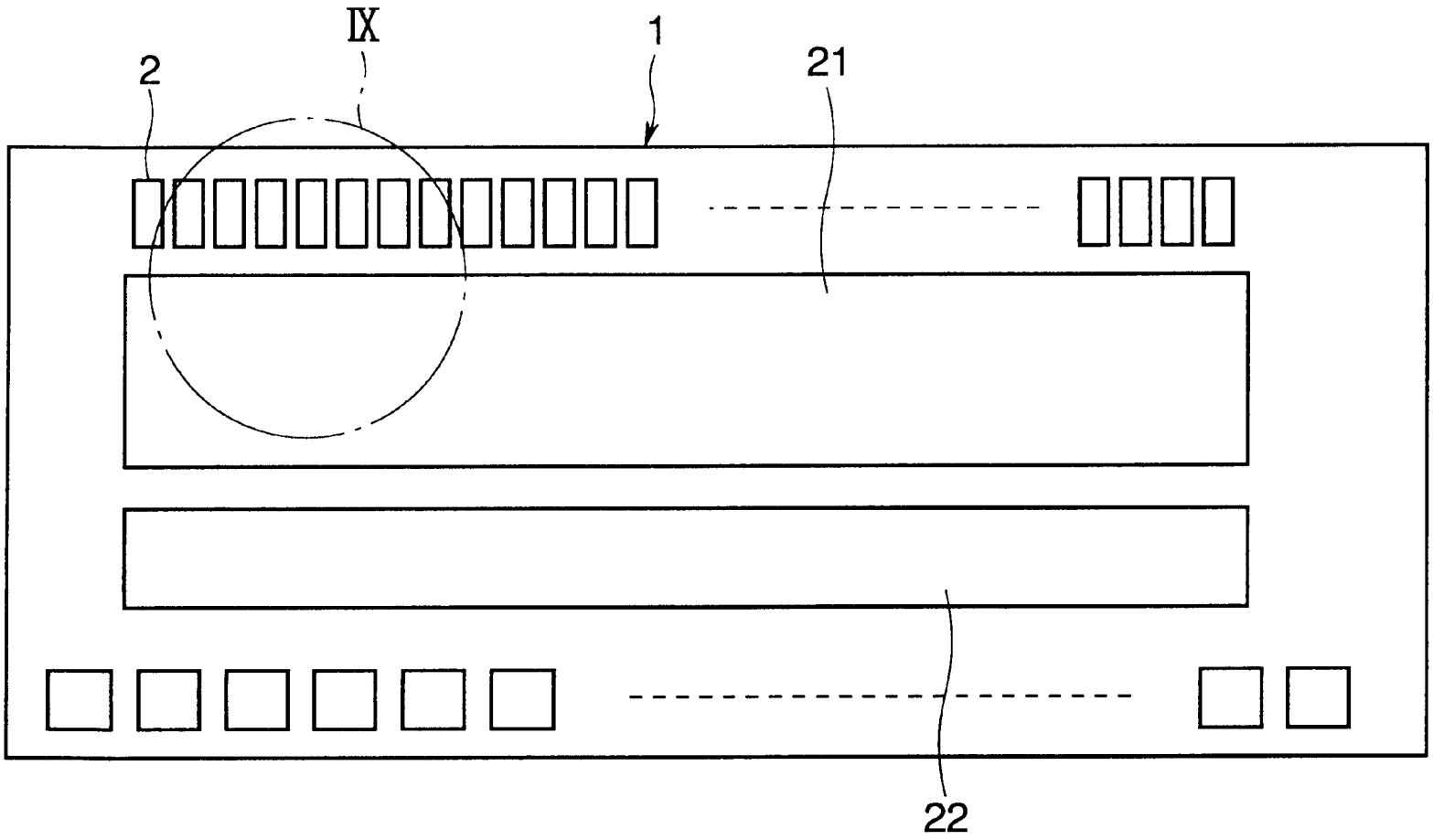
FIG. 8 is a plan view which shows the element substrate in accordance with the first embodiment.

FIG. 8 is a plan view which shows the element substrate 1 represented in FIG. 1. As shown in FIG. 8, on the surface of the element substrate 1 on the ceiling plate 3 side, a plurality of heat generating members 2 are arranged in parallel along the one edge portion of the element substrate 1. The central area of the element substrate 1 becomes the heater driver formation region 21. On the heater driver formation region 21, a plurality of heater drivers are formed in line in the same direction as the direction in which the plurality of heat generating members 2 are arranged in line. Also, on the portion of the heater driver formation region 21 on the side opposite to the heat generating member side, the shift register latches 22 are formed.

Figure 9:
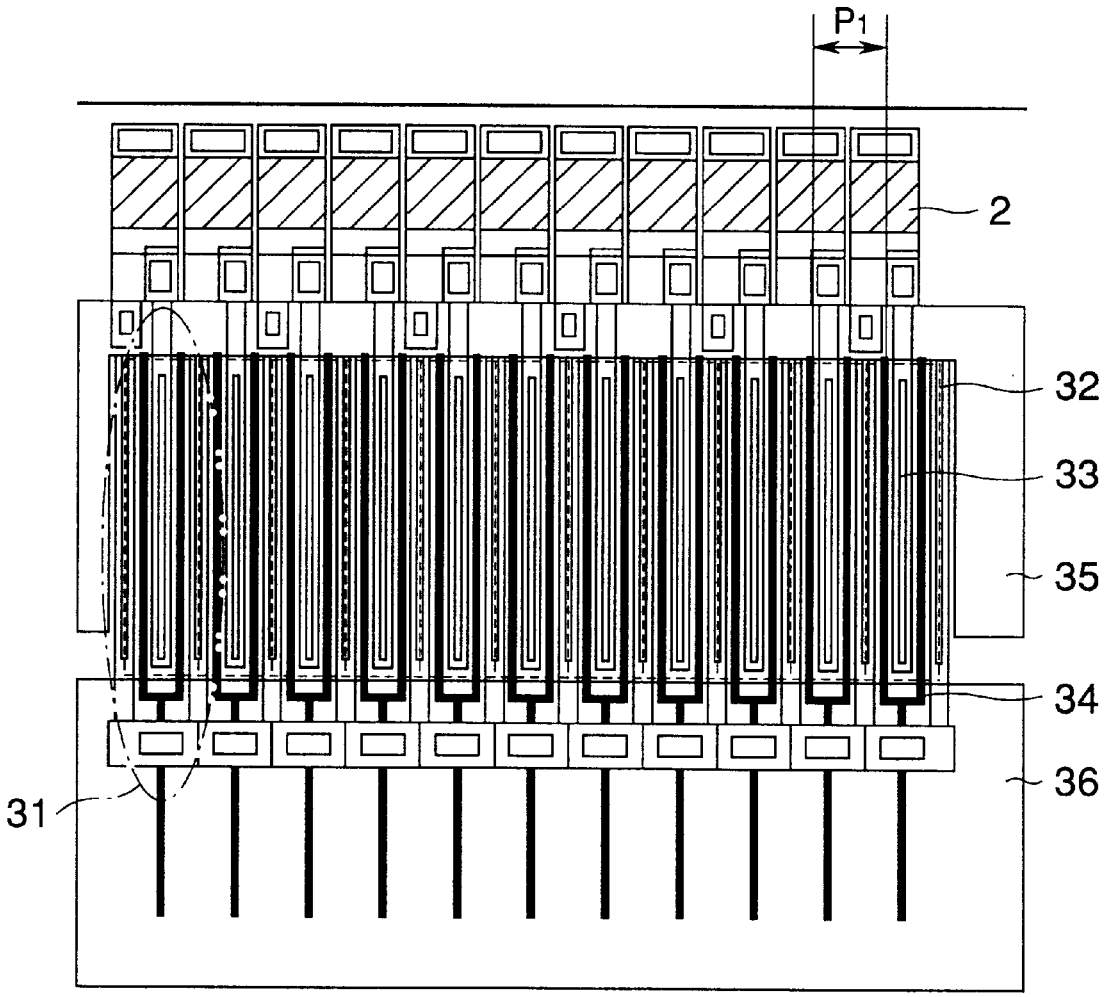
FIG. 9 is an enlarged view which shows the portion IX in FIG. 8.

FIG. 9 is an enlargement of the portion IX in FIG. 8. In accordance with the present embodiment, the element substrate 1 adopts the heater arrangement whose density is as high as 600 dpi (dot per inch) or more as the resolution of recorded images. In consideration of the wiring setup on the element substrate 1, the array of the heater drivers is arranged to be one stage for driving the heat generating members 2. On the heater driver formation region 21 shown in FIG. 8, each of the heater drivers 31 is formed in the same direction as the one in which each of the heat generating members 2 is arranged in line as shown in FIG. 9. The pitches of the heater drivers 31 is equal to the pitches of the heat generating members 2. Here, the pitch P1 is 15 to 42 um.

The heater driver 31 comprises the source 32 which extends in the direction perpendicular to the arrangement direction of the heater drivers 31, the drain 33 which is in parallel with the source 32, and the gate 34. Each of the drains 33 is connected with each of the heat generating members 2 electrically. Also, there are arranged on the heater driver formation region 21, the heater driving supply-source 35 and the ground 36 formed by metallic layer.

Here, as the condition of the heater driver 31, it should withstand higher voltage (approximately 10 to 50 V), and also, the drivers can be arranged in an extremely narrow width, such as 15 to 42 um pitches as described earlier. In order to satisfy such conditions, it is possible to adopt the off set MOS, LDMOS, or VDMOS type transistor for the heater driver 31.

Figure 10:
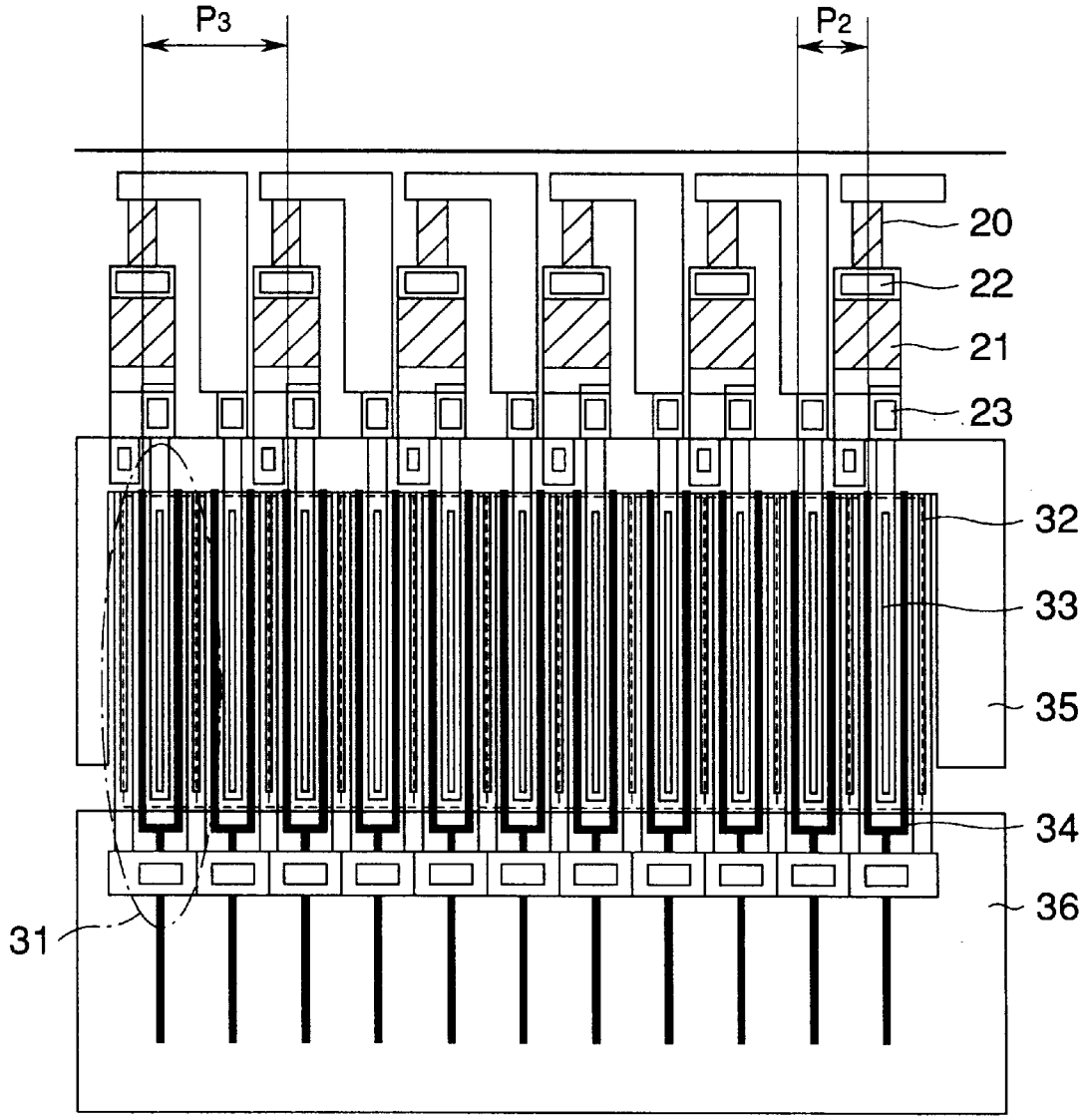
FIG. 10 is an enlarged view which shows the variational configuration of the element substrate represented in FIG. 9.

FIG. 10 is an enlarged view which shows the variational example of the element substrate 1 represented in FIG. 1. The element substrate shown in FIG. 9 has the heater drivers 31 and the heat generating members 2 at the same pitches. However, the pitch P3 of the heat generating members 20 and 21 is two times the pitch P2 of the heater driver 31 on the element substrate shown in FIG. 10. By use of such element substrate 1, a plurality of heat generating members are arranged in the ink flow direction of the ink flow paths per nozzle (liquid flow path), and then, with one nozzle, the plural heat generating members 20 and 21 are driven to perform gradation recording. More specifically, the area of the heat generating member 20, which is nearer to the discharge port is made smaller than the area of the other heat generating member 21, and at the same time, the smaller dot recording is performed by driving only the heat generating member 20 which is nearer to the discharge port. Then, by driving both the heat generating members 20 and 21 simultaneously, the larger dot recording is performed. In this manner, the difference in the discharge amounts of the smaller and larger dots is made greater without reducing the discharge speed of the smaller dots.

Here, in accordance with the present embodiment, the electrodes connected with the plural heat generating members 20 and 21 are arranged in the multi-layered structure, and the portion which becomes the common electrode is arranged on the lower layer than the plural heat generating members 20 and 21. At the same time, the structure is arranged to provide the through hole 22 with one nozzle for the electrode across the plural heat generating members 20 and 21 to connect them electrically. With the structure thus arranged, it becomes possible to provide the common electrode wiring wider even when the nozzles should be arranged in higher density. Then, it also becomes possible to keep the voltage drop that occurs in the common electrode wiring portion substantially equal when the plural heat generating members 20 and 21 are driven at the same time or individually, hence making the stabilized gradation recording possible. Also, it is desirable to make the width of the through hole 22 wider than the width of the heat generating member 20 on the discharge port side from the viewpoint of making the influence of such voltage drop smaller.

Now, the description will be made of the example in which the heat generating members 20 and 21 are arranged to make the resolution of the recording image 120 dpi with the use of the element substrate 1 structured as shown in FIG. 10. In this case, it is desirable to make the supply-source voltage required for driving the heat generating members 20 and 21 as high as possible in consideration of the wiring resistance, the fluctuation of the supply-source itself, the fluctuation of the heater drivers 31, and others. In accordance with the present embodiment, the supply-source voltage is 24 V. The supply-source (wiring electrode) 35 for driving heaters is connected with the common electrode (lower layer common electrode wiring) which is arranged on the lower layer of the heat generating members 20 and 21 by way of the through hole 23. Then, the width of the lower layer common electrode wiring is secured sufficiently larger than that of the heat generating member 21. Further, the lower layer common electrode wiring is electrically connected with the heat generating members 20 and 21 by way of the through hole 22. The width of this through hole 22 is made larger than the width of the heat generating member 20 on the discharge port side. It is 20 um in order to secure the width of individual wiring of the heat generating member 20. The length of the through hole 22 is as small as 10 um so that the trailing end of the heat generating member 21 can be positioned in front as much as possible. The pitch between heat generating members is approximately 42.3 um (600 dpi), and the width of the heat generating member 20 is 14 $\mu$m including the margins. Also, in order to secure the area of the heat generating member needed to provide the recording density of 1,200 dpi, the length of the heat generating member 20 should be made 60 um. Also, for the heat generating member 21, its width is made 26 um, which is the widest possible in consideration of the fluctuation of the nozzle width (which is approximately 30 um), and its length is 59 um. Here, in order to drive the heat generating members at intervals of several us, it is necessary to make the resistance value of the heat generating members larger, and as the sheet resistance value of each heat generating member 2, it is required to set it at 50 D/0 or more.

As described above, for the liquid discharge head having the heat generating members 2 arranged in high density, it is possible to arrange the heater drivers 31 in one line (one step) in high density on the element substrate 1 using offset MOS, LDMOS, VDMOS type, or some other transistors that serve as the heater drivers 31. In this way, an efficient wiring layout is possible on the element substrate 1. As a result, the element substrate 1 can be made smaller as the chip size. Also, the heat generating members 2 using the material having the high sheet resistance of 50 n/0 or more is combined with the high voltage heater drivers 31 capable of withstanding 10 V or more, hence making it possible to form the structure of the liquid discharge head which presents only small fluctuation of voltage applied to the heat generating members 2.

FIGS. 5A, 5B, 6A to 6C and 7A to 7D are views which illustrate the manufacture processes of the liquid discharge head sequentially in accordance with the present embodiment.

Figure 5A:
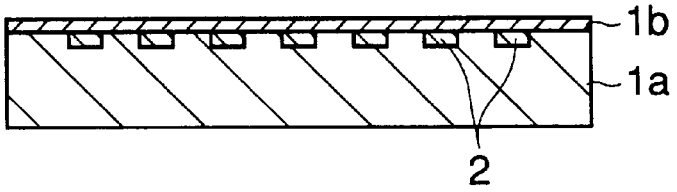
FIGS. 5A and 5B are vies which illustrate the manufacture process of the element substrate in accordance with the first embodiment.
Figure 5B:
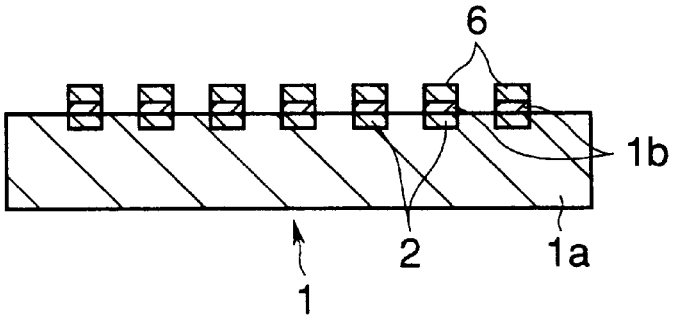

At first, on the substrate member 1*a* of the element substrate 1 structured as described above, the PSG film 1*b* is formed by the application of plasma CVD method in a thickness of approximately 5 $\mu$m (see FIG. 5A). Then, patterning is executed by the application of the photolithography or some other known method. After that, using the $\mu$W-CVD (Microwave Chemical Vapor Deposition) method each of the movable members 6 is formed with SiN film in a thickness of approximately 5 um. At this juncture, only the liquid flow path portion of the PSG film and the movable members 6 are patterned in the form of comb (see FIG. 5B).

Figure 6A:
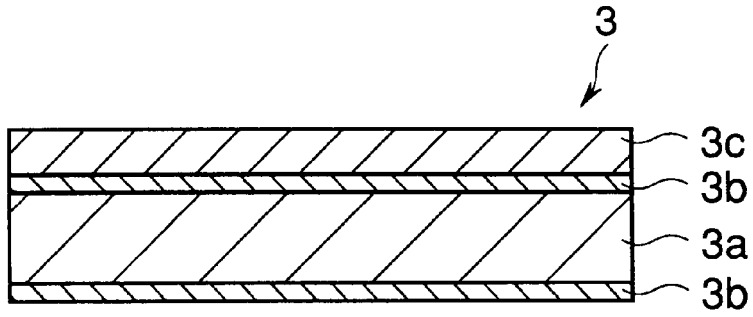
FIGS. 6A, 6B and 6C are views which illustrate the manufacture process of the ceiling plate in accordance with the first embodiment.
Figure 6B:
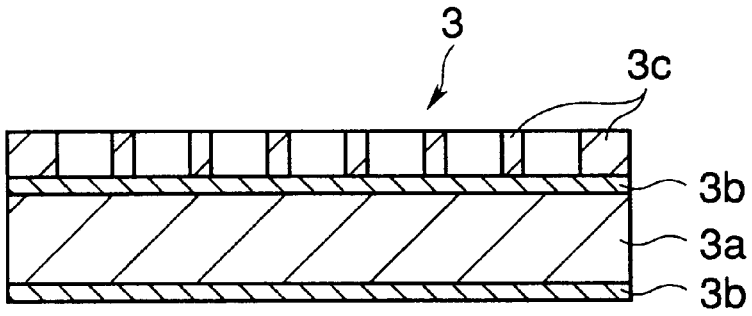
Figure 6C:
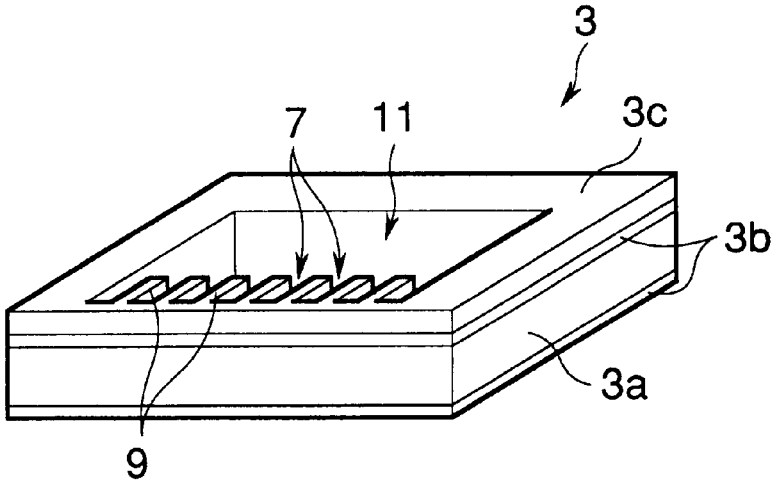

On the other hand, for the ceiling plate 3, the thermally oxidized $SiO_2$ film 3*b* is formed on both faces of a silicon wafer 3*a*. Then, using the known method, such as photolithography, the portion becoming the common liquid chamber is patterned for the formation of the silicon substrate. After that, on this silicon substrate, the layer 3*c* of SiN or the like, which becomes the flow path side walls 9, is formed by the application of $\mu$W-CVD method in a thickness of approximately 20 $\mu$m (see FIG. 6A). Subsequently, using the photolithography or some other known method the discharge port portion and the liquid flow path portion are patterned, and then, with the etching apparatus that uses the dielectric coupling plasma, etching is performed to obtain the trenching structure. After that, using TMAH (tetramethyle ammonium hydroxide) the silicon wafer penetration etching is conducted to complete the silicon ceiling plate 3 having the discharge port plate formed integrally as one body (see FIG. 6H). Here, FIG. 6C is a perspective view which shows the completed ceiling plate 3.

Figure 7A:
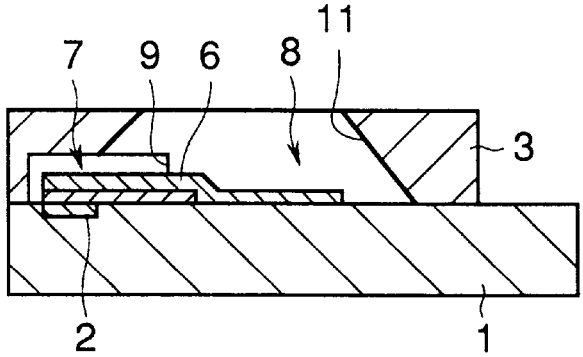
FIGS. 7A, 7B, 7C and 7D are views which illustrate the manufacture process of the element substrate and the ceiling plate subsequent to its bonding in accordance with a second embodiment of the present invention.
Figure 7B:
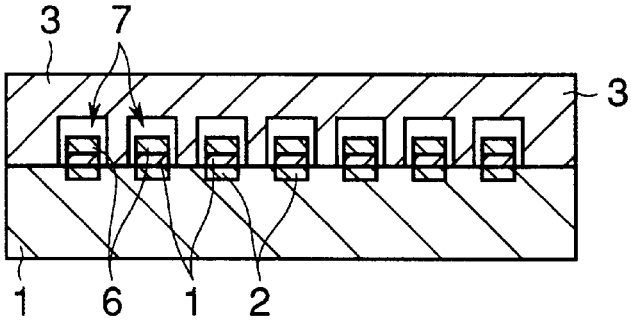
Figure 7C:
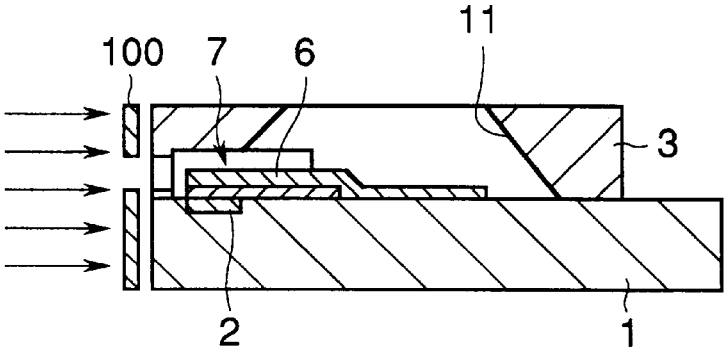
Figure 7D:
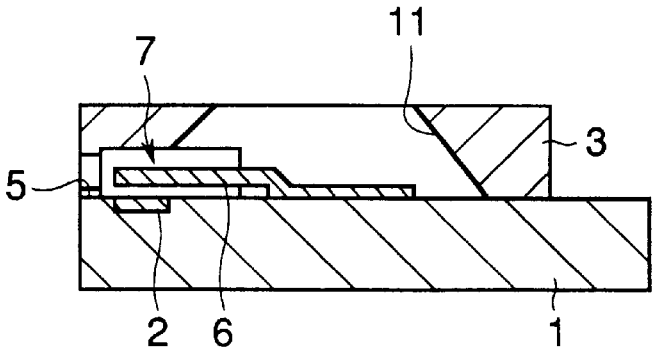

Meanwhile, the cavitation proof film 107 on the portion of the element substrate 1 where it is coupled with the ceiling plate 3 is patterned by the known method, such as photolithography. Then, in the vacuum atmosphere, the element substrate 1 and the ceiling plate 3 (FIG. 6C) are bonded at the room temperature as shown in FIGS. 7A and 7B after the bonding portions thereof are irradiated by Ar gas or the like in order to arrange the surfaces thereof in the activated condition. FIG. 7A is the side sectional view which shows the state where the element substrate 1 and the ceiling plate 3 are bonded. FIG. 7B is the front sectional view thereof. As clear from FIG. 7B, the liquid flow paths 7, the common liquid chamber 8, and the supply opening 11 are formed for the ceiling plate 3 when it is bonded. However, no discharge ports have been formed as yet. Now, therefore, as shown in FIG. 7C, using the mask 100 the discharge ports 5 are formed by ion beam processing (see FIG. 7D) in the vacuum atmosphere. Then, the PSG film 1*a* is removed by the application of wet etching in order to form the gap between the heat generating members and the movable members for the generation of initial bubbles. Thus, the liquid discharge head of the present embodiment is completed.

In accordance with the present embodiment, the movable members 6, the side walls of the liquid flow paths, and the element substrate 1 that supports the movable members, and the ceiling plate 3 which is the member to support the side walls of the liquid flow paths are all formed by the material that contains silicon, and the thermal expansion coefficients thereof are substantially the same. Therefore, even if the temperature rises along with high speed printing, it is possible to keep the relative positional accuracy and close contactness between each of the members and secure the operational stability of the movable members. As a result, ink can be discharged stably in the wider range of temperatures to make it possible to perform highly efficient printing in higher quality. Also, the side walls of the liquid flow paths are formed by patterning the material containing silicon which has been formed on the surface of the ceiling plate. Therefore, the sectional configuration of each liquid flow path can be made square so that its highly densified arrangement is possible, at the same time, excellent resistance to ink is obtained for the side walls of the liquid flow paths. Further, in accordance with the present embodiment, the element substrate 1 and the ceiling plate 3 are bonded without using any bonding agent, hence making it possible to prevent the fluctuation of flow path resistance, and also, the degradation of the discharge performance that may be caused by the dripping of bonding agent. In this respect, however, the present invention is not necessarily limited to the bonding method described above.

Also, with the material that contains silicon, particularly inorganic compound, such as silicon nitride, which is adopted for the formation of the element substrate 1 and the ceiling plate 3, it becomes easier to obtain higher density with easier processing.

Also, it is possible to enhance the bond strength with the application of pressure when the bonding is made, while activating the surfaces to be bonded.

Also, the durability of the movable members is enhanced if the members are formed by deposited film material by the application of radical reaction which is decomposed by the irradiation of the high density plasma, and then, such film is composed to be amorphous without having any grain boundaries.

(Second Embodiment)

Now, the description will be made of the method for manufacturing the liquid discharge heads in accordance with a second embodiment of the present invention. For the present embodiment, the mode is shown in which the liquid flow paths 7 and the common liquid chamber 11 are installed on the element substrate 12 side, not on the ceiling plate 13.

FIGS. 11A to 11E, 11N to 11R, 12F to 12I and 12S to 12V are views which illustrate the manufacture processes of the method for manufacturing the liquid discharge head of the present embodiment. In this respect, FIGS. 11A to 11E and 12F to 12I are sectional views taken in the direction perpendicular to the extending direction of the liquid flow paths. FIGS. 11N to 11R and 12S to 12V are cross-sectional views taken in direction of the liquid flow paths.

Figure 11A:
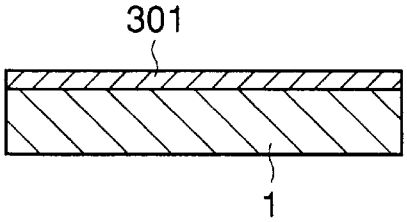
FIGS. 11A, 11B, 11C, 11D, 11E, 11N, 11O, 11P, 11Q and 11R, FIGS. 12F, 12G, 12H, 12I, 12S, 12T, 12U and 12V, FIGS. 13J, 13K, 13L, 13M, 13W, 13X, 13Y and 13Z are views which illustrate the manufacture processes in accordance with a third embodiment of the present invention.
Figure 11B:
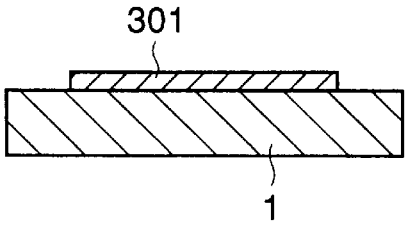
Figure 11C:
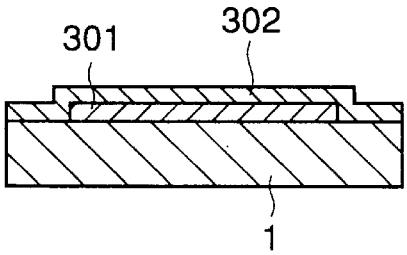
Figure 11D:
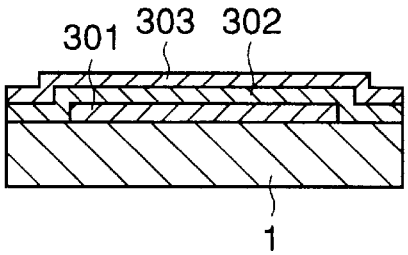
Figure 11E:
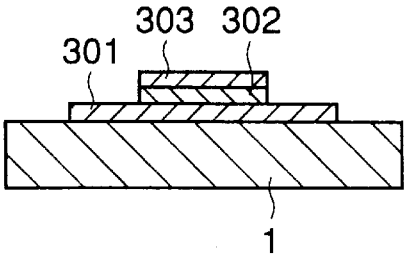
Figure 11N:
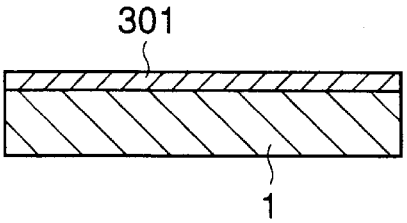
Figure 11O:
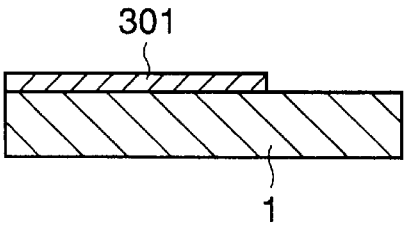

At first, in FIGS. 11A and 11N, the PSG (Phospho Silicate Glass) film 301 is formed on the entire surface of the element substrate 1 on the heat generating member 2 side by the application of CVD method at a temperature of 350° C. The PSG film 301 corresponds to the gap between the movable members 6 and the heat generating members 2 shown in FIG. 1. The film thickness of the PSG film 301 is 1 to 20 $\mu$m. In this way, the movable members 6 produce remarkable effects in terms of the entire balance of liquid flow paths of the liquid discharge head. Then, in order to pattern the PSG film 301, resist is coated on the surface of the PSG film by the application of spin coating or the like. After that, the exposure and development are conducted by the application of photolithography, and then, the resist on the portion, which corresponds to the portion where the removable members 6 are fixed, is removed.

Then, as shown in FIGS. 11B and 110, the portion of the PSG film 301 which is not covered by resist is removed by the application of wet etching using buffered hydrofluoric acid. After that, the resist that remains on the surface of the PSG film 301 is removed by the application of plasma ashing using oxygen plasma or by immersing the element substrate 1 in the resist remover. In this manner, the PSG film 301 remains partly on the surface of the element substrate 1. Then, such part of the PSG film 301 becomes the mold member corresponding to the space that provides the bubble generating region 10. Through such process, the mold member corresponding to the space for the bubble generating region 10 is prepared on the surface of the element substrate 1.

Figure 11P:
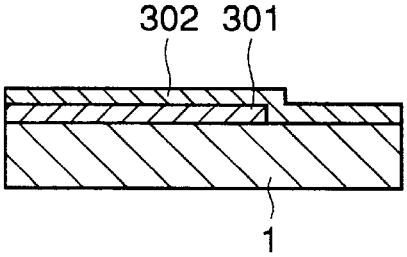

Now, as shown in FIGS. 11C and 11P, on the surfaces of the element substrate 1 and the PSG film 301, the SiN film 302 is formed by the application of sputtering method in a thickness of 1 to 10 $\mu$m as a first material layer. A part of this SiN film 302 becomes each movable member 6. As the composition of the SiN film 302, it is most preferable to use $Si_3N_4$, but the composition may be in a range where given Si as 1, the ratio of N is 1 to 1.5 in order to obtain the effect of the movable member 2. This SiN film is generally used for the semiconductor process, and it has resistance to alkali, chemical stability, and resistance to ink. Since a part of the SiN film 302 becomes each of the movable members 2, there is no restriction on the method for manufacturing this film as far as the material of this film is formed and composed to be able to provide the optimal material value as the movable member 2. For example, it may be possible for a method for forming the SiN film 302 to adopt plasma CVD, atmospheric CVD, LPCVD, bias ECRCVD, microwave CVD, or coating method, instead of the sputtering method described earlier. Also, it may be possible to change the composition ratio of the SiN film step by step in order to make it the multilayered film for the enhancement of its physical properties, such as stress, robustness, Young's modulus and its chemical properties, such as resistance to alkali, resistance to acid, depending on the way of its use or it may be possible to add impurities step by step to this film to make it the multilayered film or add impurities as the single layer.

Figure 11Q:
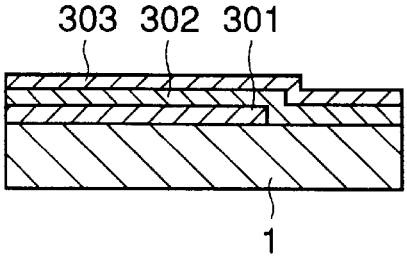

Then, as shown in FIGS. 11D and 11Q, the etching proof protection film 303 is formed on the surface of the SiN film 302. As the etching proof protection film 303, the Al film is formed by the application of sputtering method in a thickness of 2 $\mu$m. With this etching proof protection film 303, the SiN film 302 which becomes the movable member 6 is prevented from being damaged when etching is conducted in the next process to form the flow path side walls 9. Here, if the movable member 6 and the flow path side walls 9 are formed by substantially the same material, the movable member 6 should also be etched when the flow path walls 9 are formed. Therefore, it is necessary to prevent the movable member 6 from being damaged by such etching. Then, on the surface of the SiN film that becomes the movable member, which is the side opposite to the element substrate 1 side, the etching proof protection film 303 is formed.

Figure 11R:
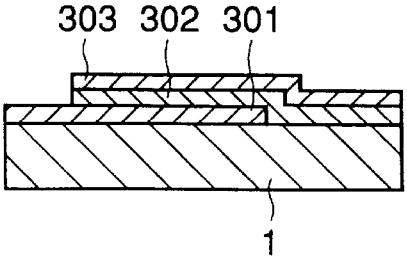

Subsequently, in order to configure the SiN film 302 and the etching proof protection film 303 specifically, resist is spin coated on the surface of the etching proof protection-film 303, which is patterned by the application of photolithography. After that, as shown in FIGS. 11E and 11R, the SiN film 302 and the etching proof protection film 303 are formed into the shape of each movable member 6 by etching them by the application of dry etching using $CF_4$, gas, reactive ion etching, or the like. Thus, on the surface of the element substrate 1, each of the movable members 6 is incorporated. Here, the etching proof protection film 303 and the SiN film 302 are etched simultaneously, but only the protection film 303 is patterned into the shape of the movable member 6, and then, the SIN film 302 may be patterned in the later process.

Figure 12F:
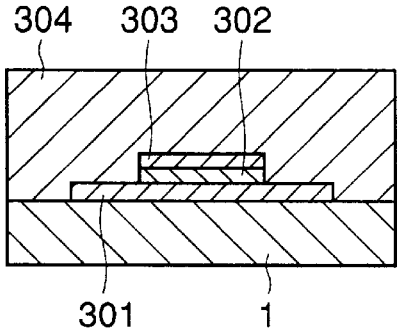
Figure 12S:
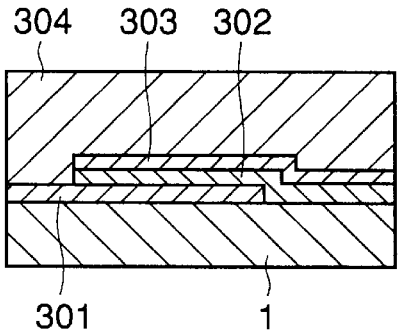

Subsequently, as shown in FIGS. 12F and 12S, the SiN film 304 is formed on the surfaces of the etching proof protection film 303, the PSG film 301, and the element substrate 1 in a thickness of 20 to 40 $\mu$m as a second material layer. If it is desired to form the SiN film at higher speeds, the $\mu$W-CVD method is used. This SiN film 304 becomes the flow path side walls 9 ultimately. The SiN film 304 is not affected by the fineness of the film which is usually required for the process of semiconductor manufacture, such as the density of pin holes and other film properties. It should be good enough if only the SiN film 304 can satisfy the resistance to ink and the mechanical strength as the flow path side walls. There is no particular problem even if the density of pin holes of the SiN film 304 is slightly heavier due to its high speed formation.

Also, the SiN film is used here, but the material of the flow path side walls 9 is not necessarily limited to the SiN film. An SiN film containing impurities, an SiN film whose composition has been changed, or the like, may be adopted if only it has the required mechanical properties and resistance to ink. Also, it may be possible to use diamond film, amorphous carbon hydride film (diamond like carbon film), alumina, zirconia, or some other inorganic films.

Now, in order to configure the SiN film the specifically, resist is coated on the surface of the SiN film 304 by spinning or the like, and patterning is conducted by means of photolithography. Then, dry etching using $CF_4$ gas or the like or reactive etching is conducted to make the SiN film 304 the shape of flow path side walls 9 or with the higher etching in view, ICP (Induction Coupling Plasma) etching is most suitable for etching the thick SiN film 304. Through such process of manufacture, the flow path side walls 9 are incorporated on the surface of the element substrate 1.

Figure 12G:
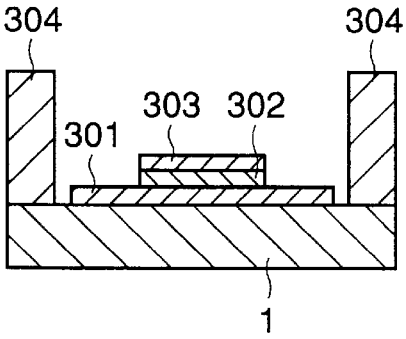
Figure 12T:
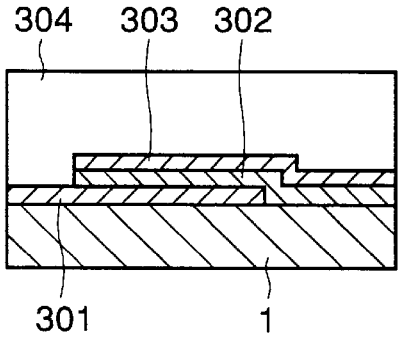

Then, as shown in FIGS. 12G and 12T, subsequent to the etching of the SiN film 304, resist that remains on the SiN film 304 is removed by the application of plasma ashing using oxygen plasma or by immersing the element substrate 1 into the resist remover.

Figure 12H:
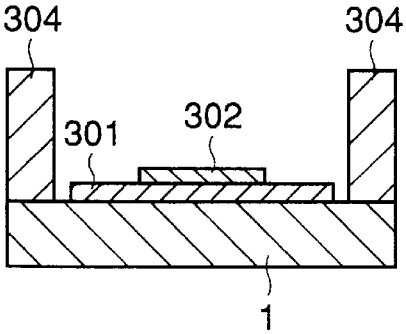
Figure 12U:
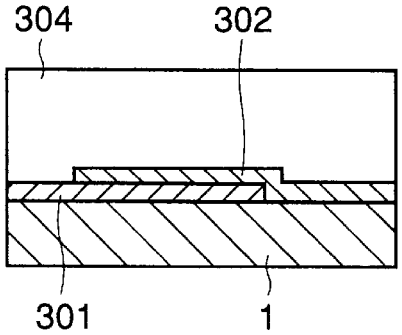

After that, as shown in FIGS. 12H and 12U, the etching proof protection film 303 on the SiN film 302 is removed by means of wet etching or dry etching. Here, the removal thereof is not necessarily limited to the method described above, but if only the etching proof protection film 303 can be removed alone, any method may be adoptable or there is no need for removing the etching proof protection film 303 at all if this film does not exert any unfavorable influence on the characteristics of the movable member 6, and also, this film may be formed by the Ta film or the like which has high resistance to ink.

Figure 12I:
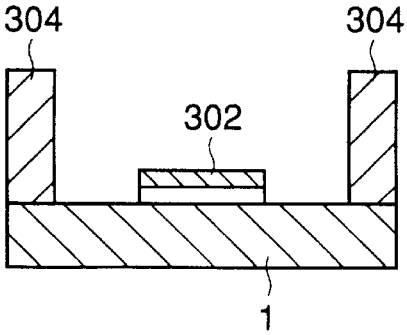
Figure 12V:
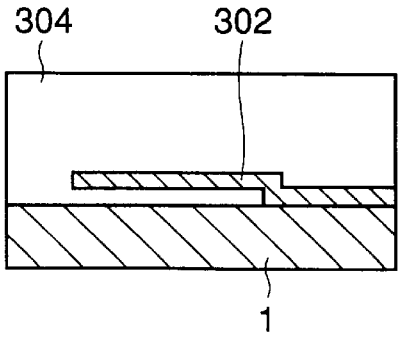

Then, as shown in FIGS. 12I and 12V, the PSG film 301, which is the lower layer of the SiN film 302, is removed using buffered hydrofluoric acid to complete the element substrate 1.

On the other hated, by the application of silicon wafer penetration etching which uses TMAH, the common liquid chamber 11 is formed on the ceiling plate 3 made of the material containing silicon. Then, the element substrate 1 and the ceiling plate 3 are bonded to complete the liquid discharge head (see FIGS. 13I to 13M and 13W to 13Z).

For the method for manufacturing liquid discharge heads described above, and the liquid discharge head thus manufactured, the movable members 6 and the flow path side walls 9 are incorporated directly on the element substrate 1. Therefore, as compared with the method wherein the respective members are manufactured separately, and then, the liquid discharge head is assembled with such members, the manufacture process of the present embodiment is simplified without assembling process. Also, the movable members are not bonded by use of bonding agent. As a result, there is no possibility that liquid in the first liquid flow paths 7*a* and the second liquid flow paths 7*b* is contaminated with the bonding agent. Further, the surface of the element substrate 1 is not scratched when it is completed, and, therefore, no dust particles occur when the movable members 6 are bonded. Then, the respective parts are formed through photolithography, etching, and some other semiconductor manufacture processes, hence making it possible to form the movable members 6 and the flow path side walls 9 in higher precision, and in higher density as well.

For the liquid discharge head of the present embodiment, the movable members 6, the flow path side walls 9, the element substrate 1 which is the member that supports the movable members and the flow path side walls are of course formed all by the materials that contain silicon whose thermal expansion coefficient is substantially the same. As a result, the relative positional accuracy and the close contactness between the respective members are maintained even if the temperature rises along with higher speed printing, thus securing the stable operation of movable members. Therefore, stable ink discharges are possible in a wider temperature range for the execution of highly efficient printing in higher quality. Also, the flow path side walls are formed by patterning the material containing silicon, which is filmed on the surface of the ceiling plate. As a result, the sectional configuration of each of the flow paths is made square, hence making it possible to effectuate the highly densified arrange thereof, and at the same time, make the resistance to ink excellent for the flow path side walls. In this respect, since the element substrate 1 dually serves as the member that supports the movable members and flow path side walls in accordance with the present embodiment, it is not necessary to use the material that contains silicon for the ceiling plate. There is no possibility that the operation of the movable members is impeded by the ceiling plate formed by the material having no silicon contained in it.

(Third Embodiment)

Figure 13J:
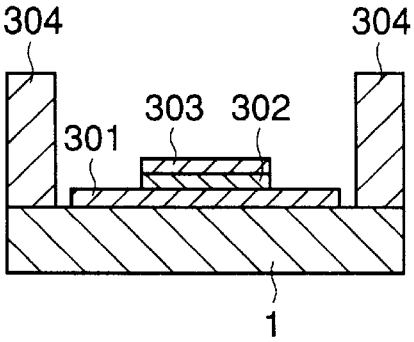
Figure 13W:
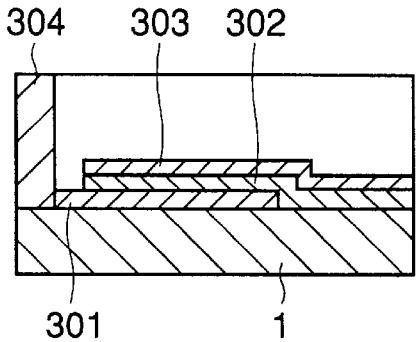
Figure 13K:
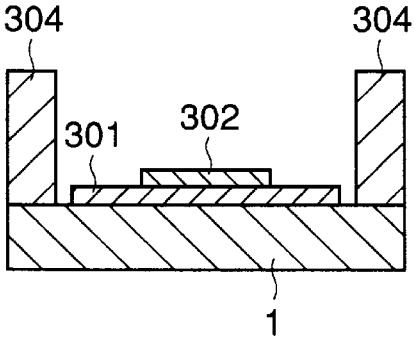
Figure 13X:
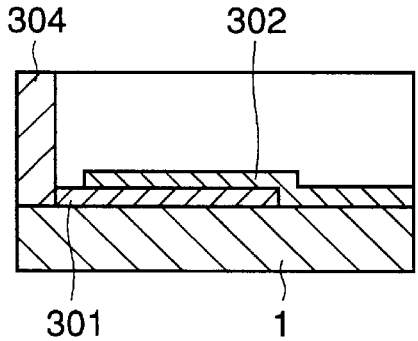
Figure 13L:
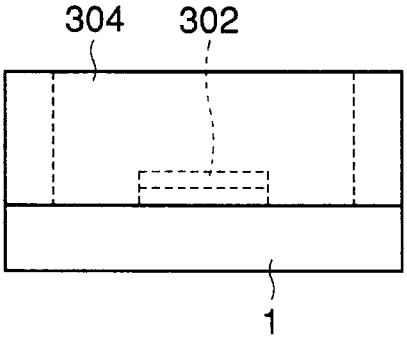
Figure 13Y:
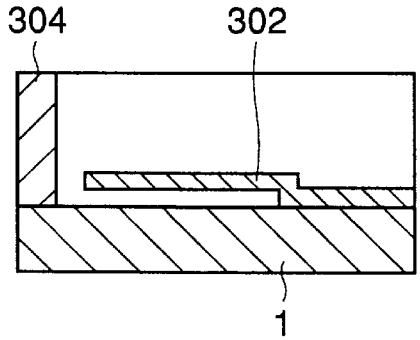
Figure 13M:
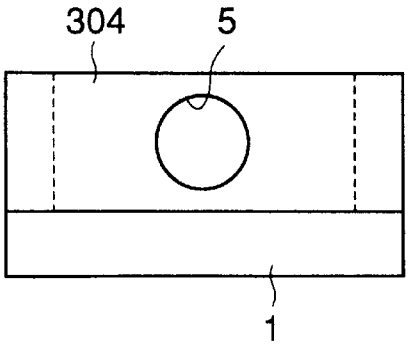

FIGS. 13J to 13M and 13W to 13Z are views which illustrate the variational example of the method for manufacturing liquid discharge heads described in conjunction with FIGS. 11A to 11E, 11N to 11R and 12F to 12I, 12S to 12V. In accordance with the manufacture method described with reference to FIGS. 11A to 11E, 11N to 11R and 12F to 121, 12S to 12V, the discharge port plate 4 can be formed together with the flow path side walls 9 simultaneously. Now, with reference to FIGS. 13I to 13M and 13W to 13Z, the description will be made of the method for manufacturing the liquid discharge heads in which the flow path side walls 9 and the discharge port plate 4 are manufactured at the same time. FIGS. 13J and 13K are cross-sectional views taken in the direction perpendicular to the direction in which the liquid flow paths extend. FIGS. 13L and 13M are front views. FIGS. 13W to 13Z are cross-sectional views taken in the liquid flow path direction. As shown in FIGS. 12F and 12S, subsequent to having formed the SiN film 304, patterning is executed by the application of photolithography so that the portions of the SiN film 304 which correspond to the flow path side walls 9 and the discharge port plate 4 are left intact as shown in FIGS. 13J and 13W. Then etching is conducted. In this manner, the discharge port plate 4 is incorporated in a thickness of 2 to 30 $\mu$m on the surface of the substrate 1 with the flow path side walls 9 which are formed at the same time.

Then, as shown in FIGS. 13K and 13X, the etching proof protection film 303 on the SiN film 302 is removed by the application of wet etching or dry etching.

Figure 13Z:
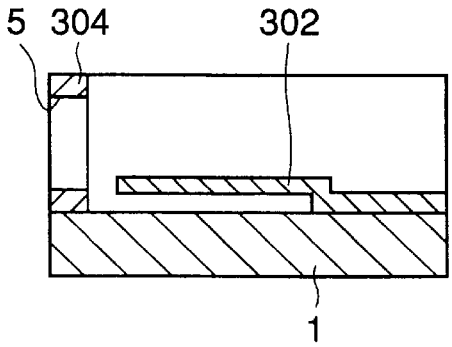
Figure 14:
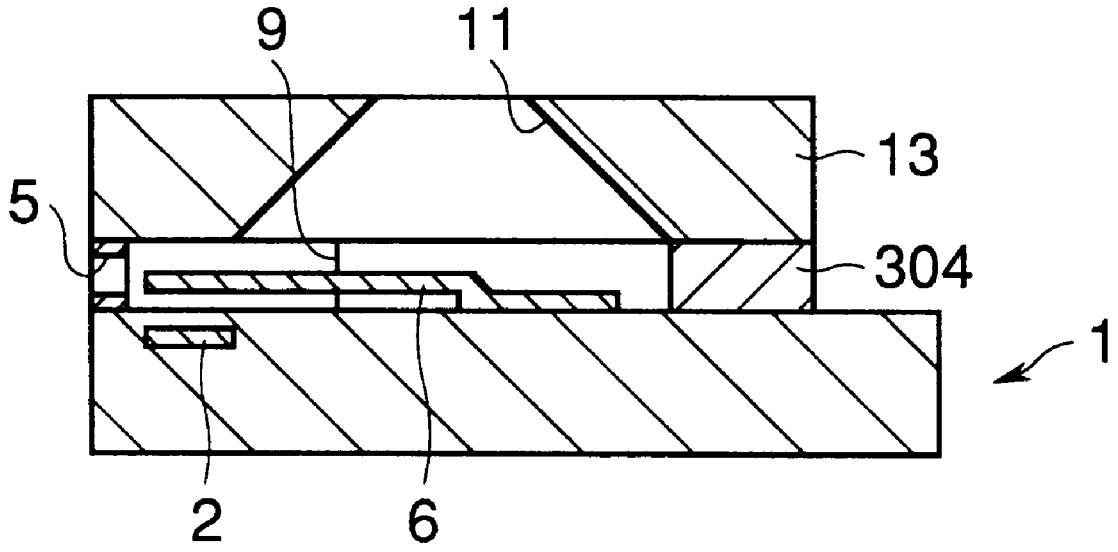
FIG. 14 is a cross-sectional view which shows a liquid discharge head in accordance with the third embodiment.

Subsequently, as shown in FIGS. 13L and 13Y, the PSG film 301 which is the lower layer of the SiN film 302 is removed using buffered hydrofluoric acid. 103. After that, as shown in FIGS. 13M and 13Z, ablation process is executed by the irradiation of excimer laser on the discharge port plate 4. At this juncture, the molecular bond of the SiN film is directly cut by KrF excimer laser provided with the photon energy of 115 kcal/mol or more having the SiN film binding dissociation energy of 105 kcal/mol or more. Since this excimer laser processing is non-thermal process, it is possible to perform highly precise processing without causing any thermal fusion or carbonization around the processed portions.

Here, as the discharge port formation material, polysulfone or some other resin having benzene rings is used conventionally for the ablation process of the discharge ports of the liquid discharge head. For the use of resin, the thickness of the member should be made slightly larger so as to secure the strength of the port formation member. Also, resin tends to swell due to moisture contained in liquid residing in the liquid flow paths. In consideration of such problem as this, the laser ablation process is attempted, while using inorganic material (such as the material that contains silicon). However, silicon oxide cannot be processed well. Here, although it is possible to process amorphous silicon, polycrystalline silicon, or silicon carbide, the processed shape tends to become dull eventually. Therefore, in accordance with the present embodiment, the discharge port formation member is formed by silicon nitride, and then, processed by laser ablation to form the discharge ports. In this manner, it is possible to form discharge ports in higher precision, while making the strength of the discharge port formation member greater than that of the conventional member. In this way, the resultant thickness of the discharge port formation member is made smaller. There is no fear that the discharge port formation member is subjected to swelling, either.

(Fourth Embodiment)

Figure 15:
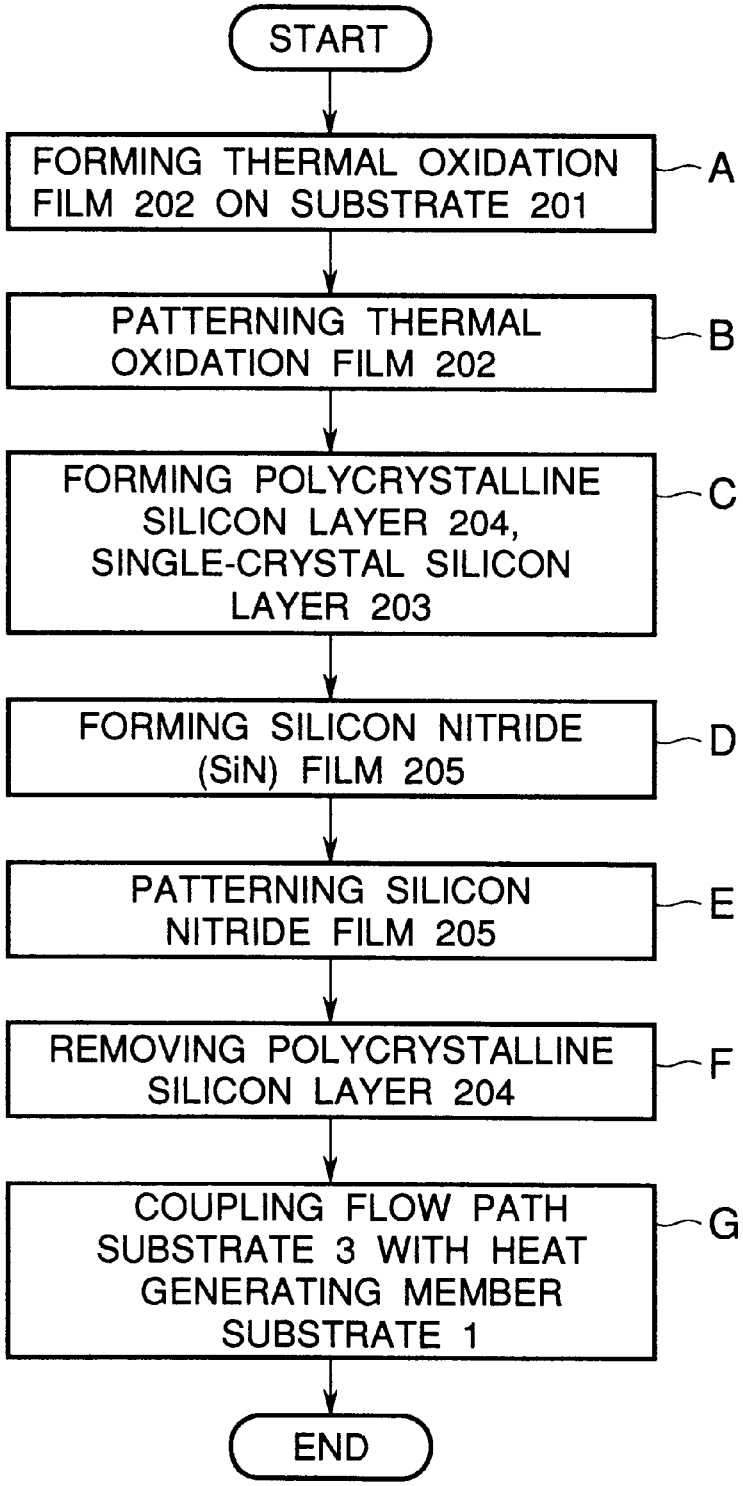
FIG. 15 is a flowchart which shows the manufacture process of a flow path substrate in accordance with a fourth embodiment of the present invention.
Figure 17A:
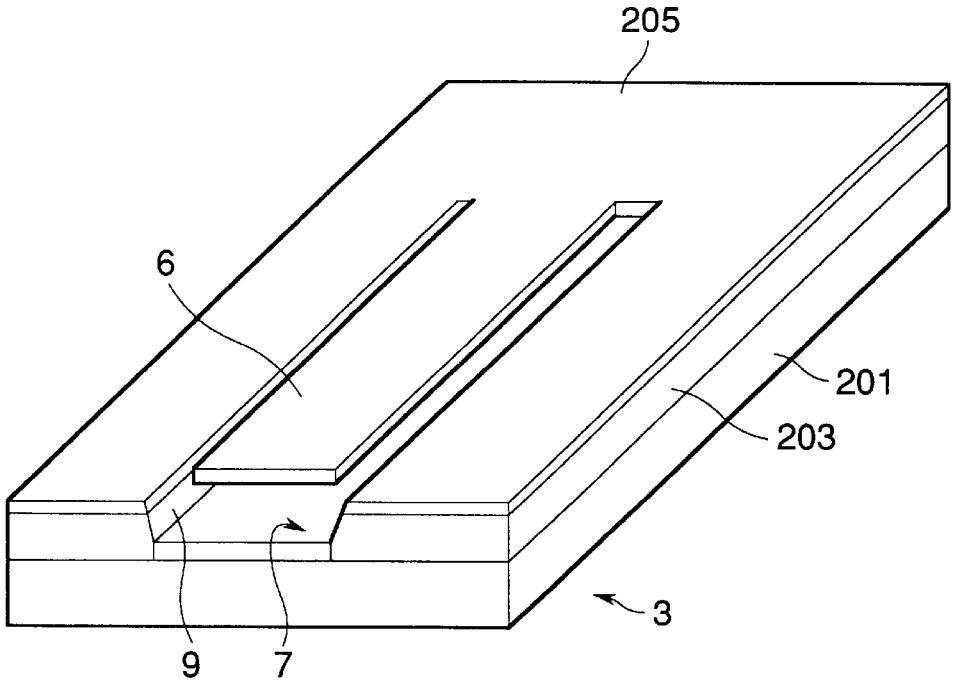
FIGS. 17A and 17B are perspective and plan views which illustrate the flow path substrate in accordance with the fourth embodiment, respectively.
Figure 17B:
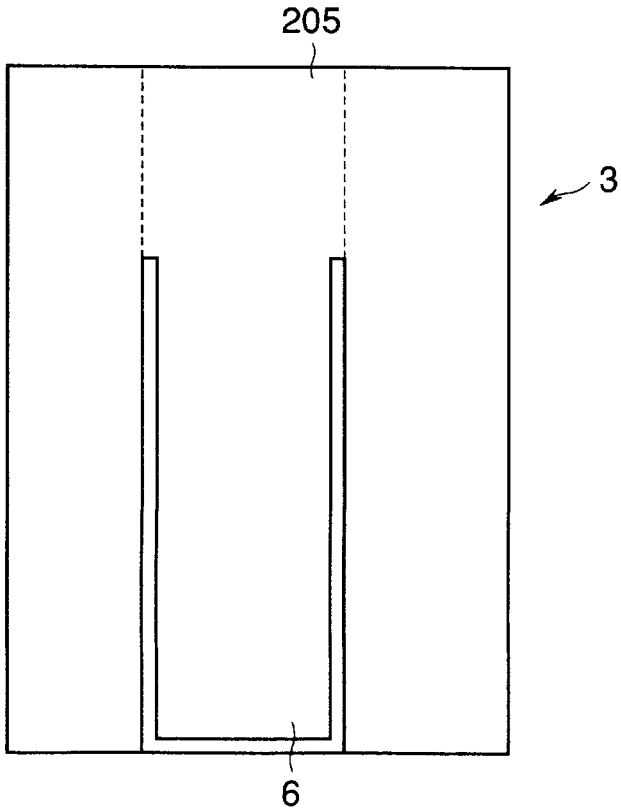
Figure 18:
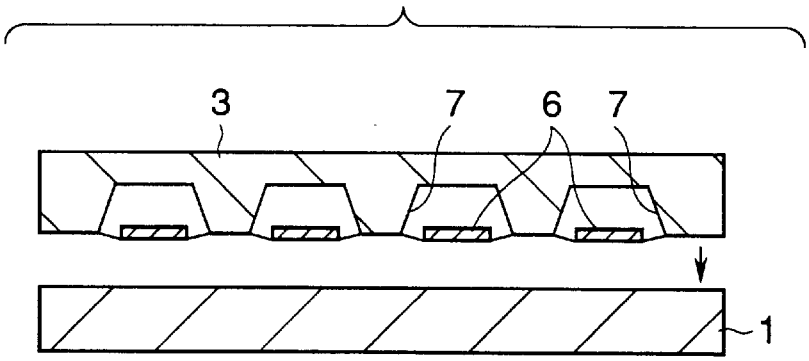
FIG. 18 is a cross-sectional view which shows the manufacture process of the flow rate substrate in accordance with the fourth embodiment.
Figure 19:
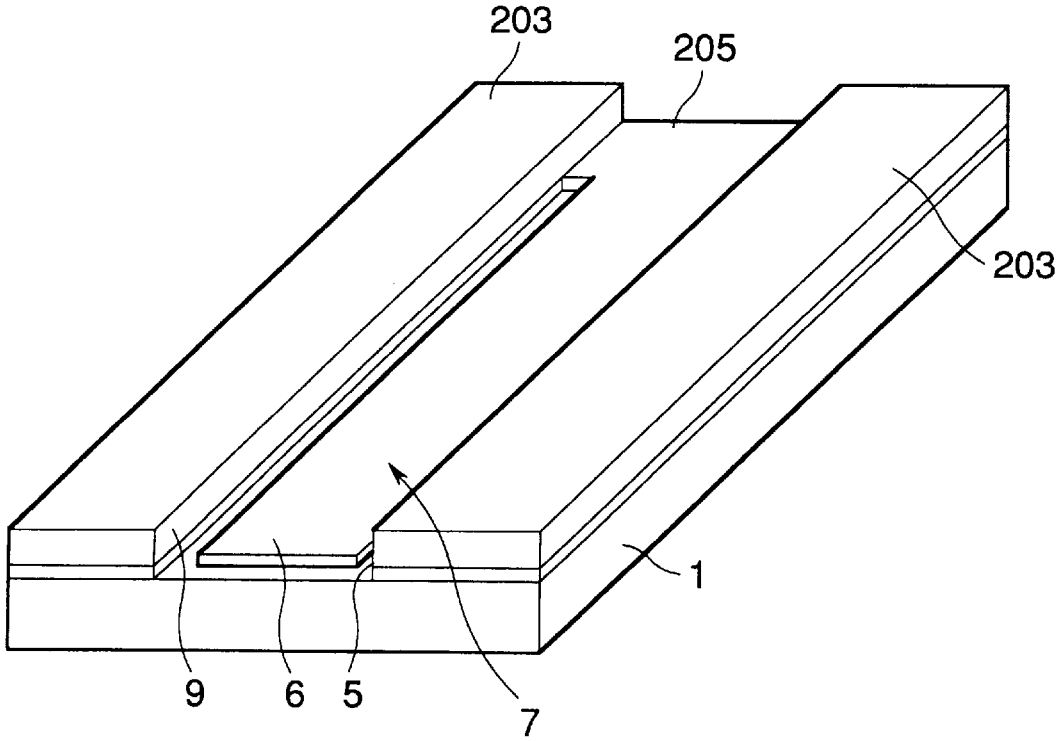
FIG. 19 is a perspective view which shows the liquid discharge head of the fourth embodiment in the state where the silicon substrate on the flow path substrate side is removed.
Figure 20:
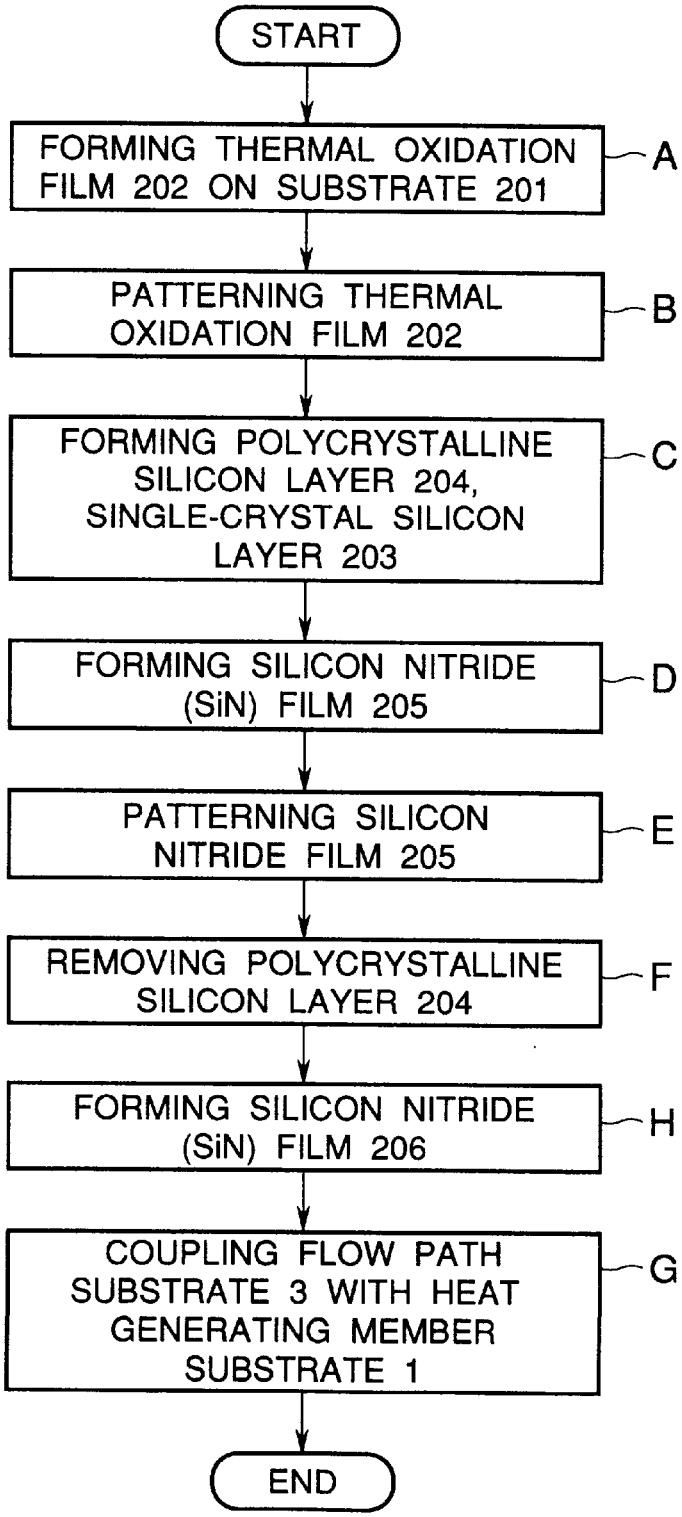
FIG. 20 is a flowchart which shows the manufacture process of the flow path substrate in accordance with a fifth embodiment of the present invention.

Now, with reference to FIGS. 15, 16A to 16F, 17A, 17B, 18 and 19, the description will be made of the manufacture processes of the flow path substrate (the ceiling plate with flow path walls) 3. FIG. 15 is a flowchart which shows the manufacture processes of the flow path substrate 3 from the steps of its own formation to the step of bonding this substrate 3 with the substrate 1 of the heat generating members 2. FIGS. 16A to 16F are cross-sectional views which schematically illustrate the manufacture processes of the flow path substrate 3 in accordance with each step thereof. FIG. 17A is a perspective view which shows the flow path substrate 3 in its complete form. FIG. 17B is the plan view thereof. FIG. 18 is a cross-sectional view which schematically shows the manufacture process in which the flow path substrate 3 is bonded with the substrate 1 of the heat generating members 2. FIG. 19 is a perspective view which shows the flow path substrate 3 which is bonded with the substrate 1 of the heat generating members 2. In this respect, only one flow path is shown in FIGS. 16A to 16F and 17A, 17B in order to simplify the representation.

Figure 16A:
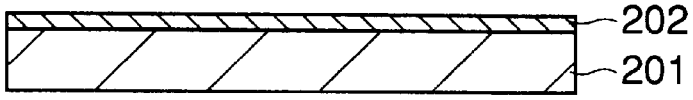
FIGS. 16A, 16B, 16C, 16D, 16E and 16F are cross-sectional views which illustrate the flow path substrate in accordance with the fourth embodiment.
Figure 16B:
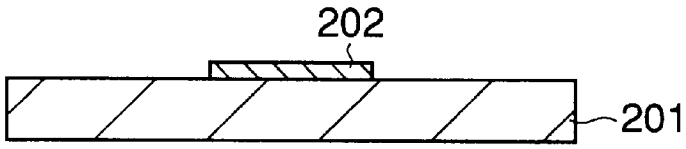
Figure 16C:
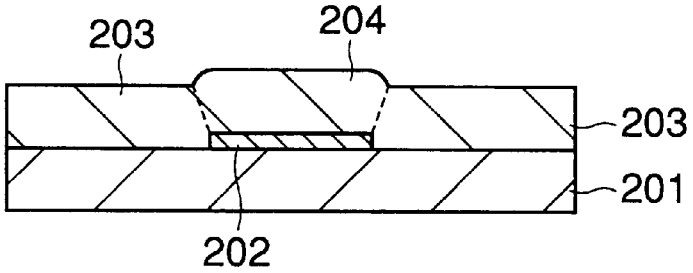

At first, as shown in FIG. 16A, on the silicon substrate 201 having the crystal orientation plane (1, 0, 0), a thermally oxidized silicon film 202 is formed in a thickness of approximately 1 $\mu$m by the application of thermal oxidation film formation method (step A). Then, as shown in FIG. 16B, by means of etching using photolithography and buffered hydrofluoric acid, the thermally oxidized film 202 is patterned to be configured specifically (step 8). Here, the film is patterned to be substantially in the same configuration as the desired flow paths. Then, as shown in FIG. 16C, by means of the epitaxial development method having silane gas as its main component, silicon is developed on the substrate 201 (step C). Thus, on the thermally oxidized film 202, a polycrystalline silicon layer 204 is formed. On the other portions, a single crystalline silicon layer 203 is developed. In this manner, two different kinds of members, such as the polycrystalline silicon layer 204 and the single crystalline silicon layer 203, are formed on the substrate. In FIG. 16C, the boundary between the polycrystalline silicon layer 204 and single crystalline silicon layer 203 is indicated by dotted line.

Figure 16D:
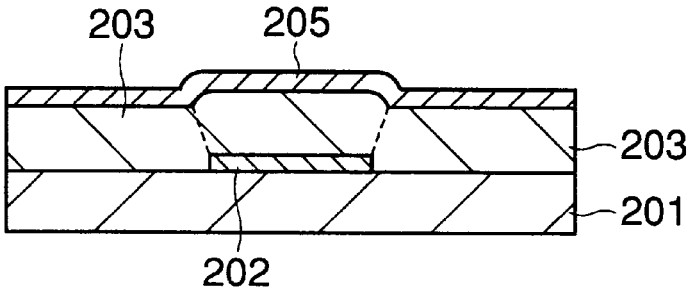
Figure 16E:
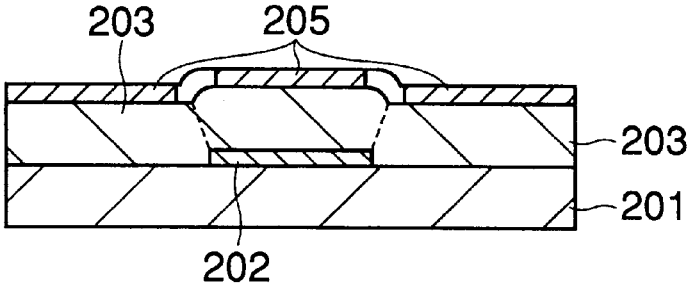

Then, as shown in FIG. 16D, a thin silicon nitride (SiN) film 205 is formed (step D) by the application of CVD method on the polycrystalline silicon layer 204 and the single crystalline silicon layer 203. Now, as shown in FIG. 16E, the silicon nitride film 205 is patterned by means of photolithography and dry etching, but to keep only the desired configuration of the movable members and that of fixing portion to be left intact (step E).

Figure 16F:
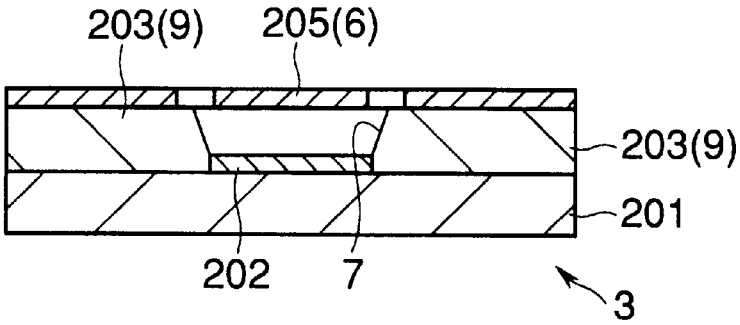

Subsequently, as shown in FIG. 16F, the substrate is dipped into tetramethyle ammonium hydride (TMAH), and then, the polycrystalline silicon layer 204 on the thermally oxidized film 202 is etched (step F). Here, the ratio of etching selection becomes greater because of the difference in polycrystalline and single crystalline of the silicon layers 204 and 203. Then, therefore, when this substrate is dipped into TMAH, the polycrystalline silicon layer 204 beings to be etched, but the single crystalline silicon layer 203 is rarely etched. Now, in this status, if the substrate is drawn out from TMAH as soon as the etching of the polycrystalline silicon layer 204 has been completed, the single crystalline silicon layer 203 and the silicon nitride film 205 are scarcely removed and left intact. In this way, the portion where the polycrystalline silicon layer is removed becomes each of the flow paths 7, and the remaining single crystalline silicon layer 203 becomes each of side walls 9 on the flow paths. Then, the silicon nitride film 205, which remains above the polycrystalline silicon layer 204 that has been removed, becomes each of the movable members 6.

In this way, the flow path substrate 3 is completed. FIGS. 17A and 17B illustrate the flow path substrate 3 in its complete form. The flow path substrate 3 having the movable members 6 thus formed, and the substrate 1 of the heat generating members which is manufactured in the other processes as described earlier are bonded as shown in FIG. 18, hence completing the liquid discharge head (step G). In accordance with the present embodiment, when the flow path substrate 3 and the substrate 1 of the heat generating members are superposed, it is possible to position them by adjusting them in the horizontal direction in the state that both substrates are superposed together even if relative positions of the substrates 1 and 3 are slightly out of place. In other words, in accordance with the present embodiment, the flow path side walls 9 and the movable members 6, which are both in the extruded state, are installed on the flow path substrate 3, while the substrate 1 of the heat generating members is a flat plate as shown in FIG. 18. Therefore, even if the flow path substrate 3 is freely shiftable when it is superposed on the substrate 1 of the heat generating member, the positioning can be made easily without any particular problem.

FIG. 19 is a perspective view which shows the liquid discharge head in a state where its silicon substrate 201 has been removed. Here, in FIG. 19, it looks as if the movable member 6 is in contact with the substrate 1 of the heat generating members, and there is no gap between them. However, since the movable member 6 is in the cantilever fashion, the gap is created by pressure or the like when ink is actually supplied to be flowing in between the movable member 6 and the substrate 1 of the heat generating members. Then, as described earlier, each of the movable member 6 controls the development direction of bubbles, hence making it possible to perform liquid discharges with higher discharge characteristics.

In this respect, although not shown, a silicon nitride film (SiN) film is formed, in place of the thermally oxidized film 202, by the application of CVD method in the step A, and in the step B, patterning is executed by means of photolithography and etching, and in the step C, silicon is developed. Even in this manner, the polycrystalline silicon layer 204 is developed on the silicon nitride film, and the single crystalline silicon layer 203 is developed on the other portions as in the formation of the thermal oxidized film 202. After that, by repeating the steps D to G, it is possible to form the liquid discharge head having the same structure as the one described above.

Also, for the present embodiment, the pair of substrates are both formed by the material containing silicon, and the thermal expansion coefficients thereof are substantially the same. As a result, even when temperature rises, the relative positional accuracy of the respective members and the close contactness between them are maintained well, hence making it possible to perform stable ink discharges within a wider range of temperatures.

In this respect, it is also possible to form the movable members 6 with thin film having material other than the silicon nitride film 205.

(Fifth Embodiment)

Now, with reference to FIG. 20 and FIGS. 21A to 21G, the description will be made of a fifth embodiment of the present invention.

For the present embodiment, the flow path substrate 11 is different from the one in the fourth embodiment. FIG. 20 and FIGS. 21A to 21G illustrate the manufacture processes of the flow path substrate 11.

Figure 21A:
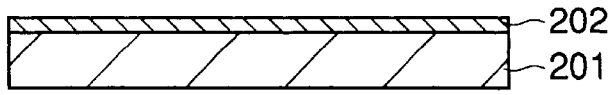
FIGS. 21A, 21B, 21C, 21D, 21E, 21F and 21G are cross-sectional views which illustrate the manufacture process of the flow path substrate in accordance with the fifth embodiment.
Figure 21B:
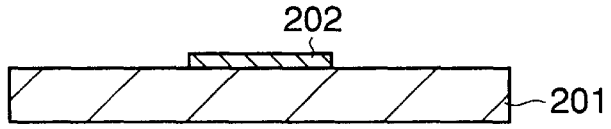
Figure 21C:
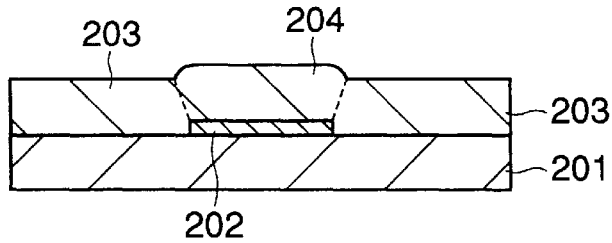
Figure 21D:
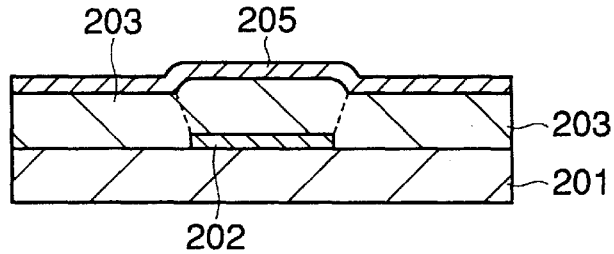
Figure 21E:
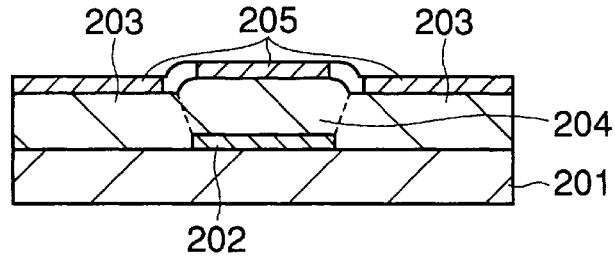
Figure 21F:
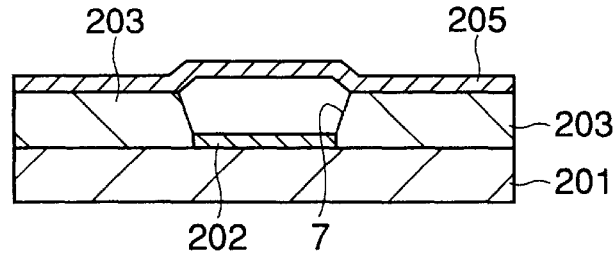
Figure 21G:
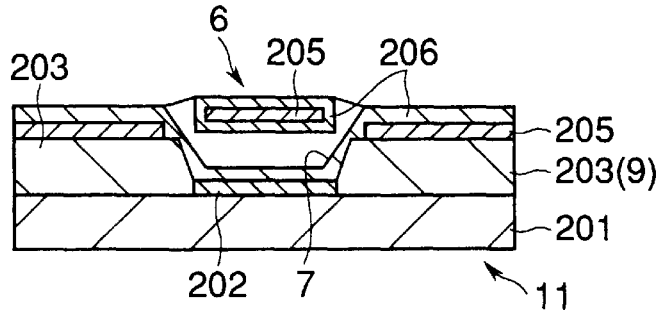

For the present embodiment, the steps A to F are the same as those of the fourth embodiment (see FIGS. 15 and 16A to 16F). In other words, as shown in FIG. 21A, a thermally oxidized silicon film 202 is formed on the silicon substrate 201 in a thickness of approximately 1 $\mu$m (step A). As shown in FIG. 21B, the thermally oxidized film 202 is patterned to be a specific shape (step B). As shown in FIG. 21C, silicon is developed on the substrate 201, and the polycrystalline silicon layer 204 is formed on the thermally oxidized film 202, while the single crystalline silicon layer 203 is formed on the other portions (step C). As shown in FIG. 21D, a silicon nitride (SiN) film 205 is formed (step D). As shown in FIG. 21E, the silicon nitride film 205 is patterned (step E). As shown in FIG. 21F, the polycrystalline silicon layer 204 is etched in TMAH (step F). In this manner, the flow paths 7 and the movable member 6 are formed.

Now, in accordance with the present embodiment, a silicon nitride (SiN) film 206 is formed (step H) by the homogeneous film thickness formation method, such as the LPCVD method at 700° C. In this way, the silicon nitride film 206 is formed on the portion of the flow path side walls where silicon is exposed. With strong resistance to alkali of approximately PH 11, the silicon nitride film 206 is not damaged at all. Therefore, it is made possible to adopt even the strong base ink which has not been in use conventionally.

Here, in accordance with the present embodiment, the portion formed by the silicon nitride film 205, such as the portion where the movable members are arranged, is superposed with the silicon nitride film 206 for the complete formation thereof. However, by use of masking or the like, it may be possible to form the silicon nitride film 206 only on the flow path side wall portion where no silicon nitride film 205 is present.

(Sixth and Seventh Embodiments)

FIGS. 22A and 22B, and FIGS. 23A and 23B illustrate the manufacture processes of liquid discharge heads in accordance with the sixth and seventh embodiments.

Figure 22A:
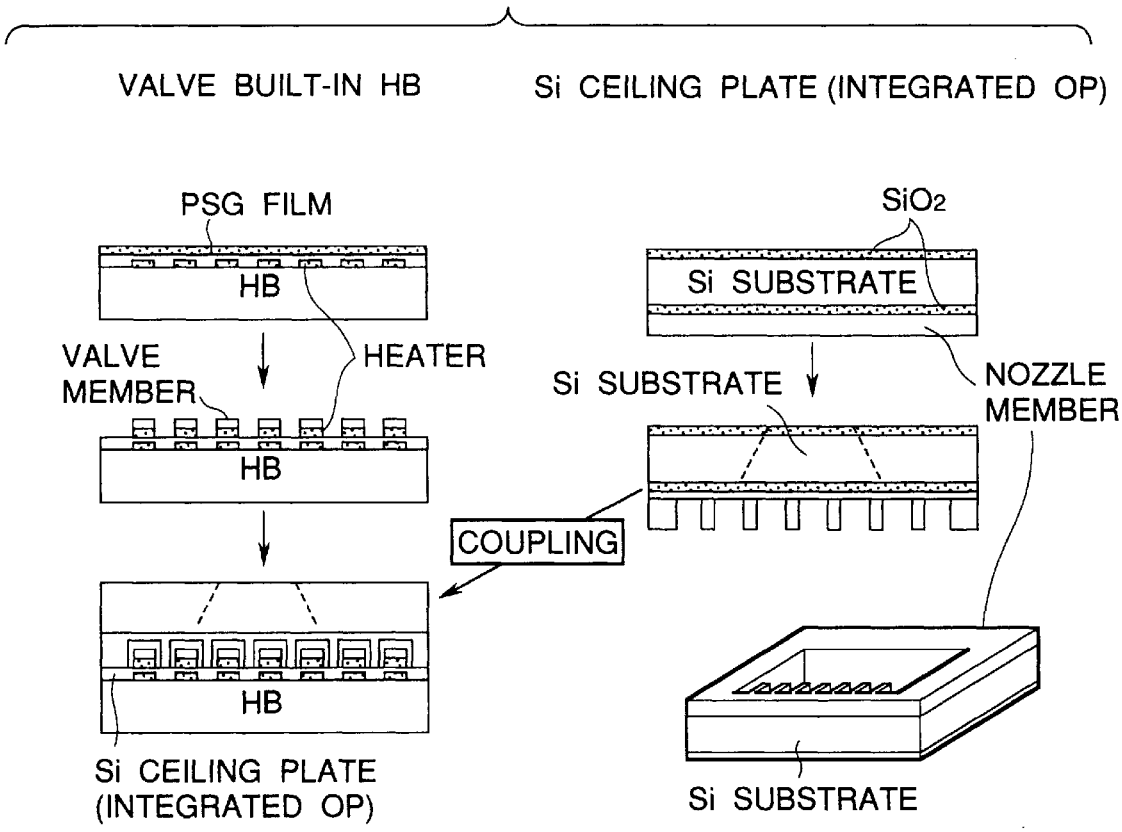
FIGS. 22A and 22B are cross-sectional views which illustrate the manufacture process of a liquid discharge head in the flow path direction in accordance with a sixth embodiment of the present invention.
Figure 22B:
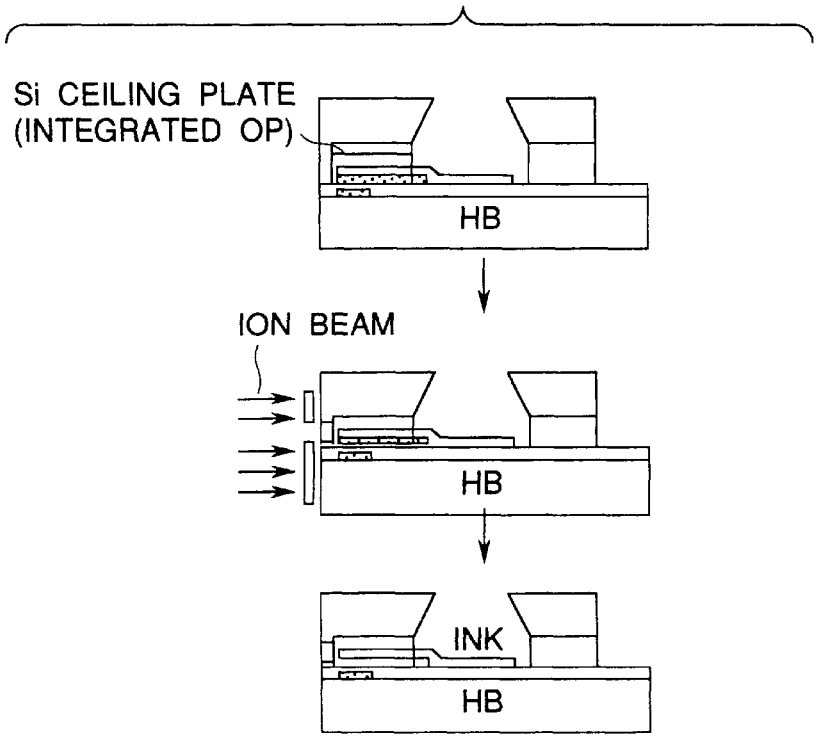

In FIGS. 22A and 22B, after the cavitation proof film is formed as described earlier, an SiN film is formed in a thickness of 3,000 Å. Then, by the application of plasma CVD method, a PSG film is formed on it in a thickness of approximately 5 $\mu$m, and patterning is made by the known method of photolithography or the like. After that, the SiN film is formed by the application of $\mu$W-CVD method in a thickness of approximately 5 $\mu$m on the PSG film for the formation of the movable members. Then, only the flow path portion is patterned in the form of comb by means of the known method of photolithography or the like. Here, although the SiN film is formed on the cavitation proof film for the purpose of obtaining resistance to ink, if Ta film is used as the cavitation proof film, there is no need for the formation of the SiN film, because the Ta film produces the same effect. In this case, the cavitation proof film on the portion where the ceiling plate is bonded is patterned by the known method of photolithography or the like before the bonding is made by the same method as described above. Also, for the silicon ceiling plate formed integrally with the orifices as shown in FIGS. 22A and 22B, the thermally oxidized $SiO_2$ film is formed in a thickness of approximately 1 $\mu$m on both sides of a silicon wafer, and the portion which becomes the common liquid chamber is patterned by the known method of photolithography or the like, and then, the SiN film which becomes the nozzle member is formed by the application of $\mu$W-CVD method in a thickness of approximately 20 $\mu$m. After that, the orifice portion and the flow path portion are patterned by means of the known method of photolithography or the like. Thus, the trench formation etching is conducted by use of the etching apparatus that utilizes induction coupling plasma (ICP). Subsequently, using TMAH, the silicon wafer penetration etching is executed to complete the silicon ceiling plate integrally formed with the orifice. In FIGS. 22A and 22B, the common liquid chamber is made in the form of oblique square. However, with patterning from both faces of the wafer, it is possible to form the common liquid chamber in various kinds of configurations. Then, the SiN film is formed in the same manner as described above in order to protect the Si surface which is exposed by the etching. Here, the common liquid chamber and the orifice portion can be formed simultaneously. However, if the film formation of the nozzle member and its etching are conducted at first after the formation of the common liquid chamber, it is possible to omit the formation process of the Si protection film.

Then, the head substrate having the movable members incorporated on it, and the silicon ceiling plate formed integrally with the orifice are bonded at the room temperature after the surfaces thereof are activated by irradiating the Ar gas or the like onto the bonding portions of both members in the vacuum atmosphere as in the sixth embodiment. After that, the orifice portion is processed by the application of ion beam in the vacuum atmosphere. At this puncture, it is possible to process this portion to provide the inverted taper structure depending on the powers of ion beam. Also, in place of ion beam, electron beam may be applied. Then, in order to form the gap where bubbles created initially between each of the heat generating members and movable members, the PSG film is removed by means of wet etching, hence completing the liquid discharge head of the present invention.

Figure 23A:
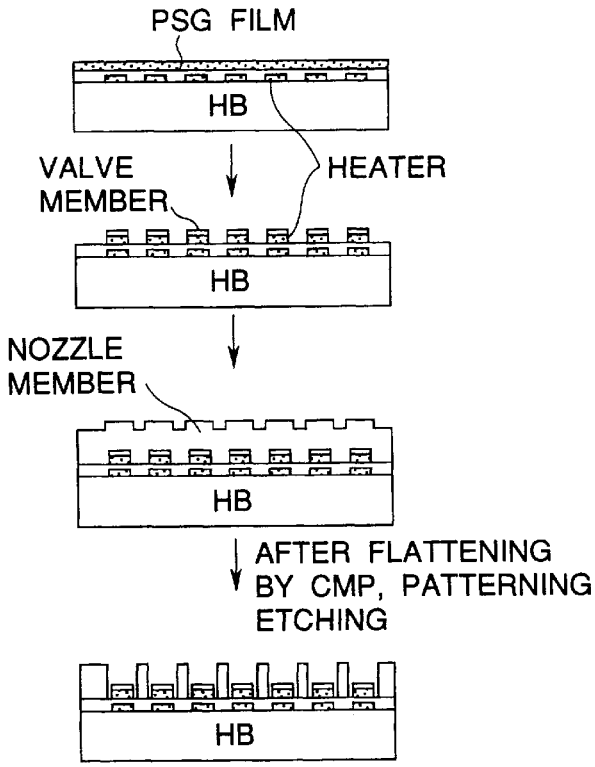
FIGS. 23A and 23B are cross-sectional views which illustrate the manufacture process of a liquid discharge head in the flow path direction in accordance with a seventh embodiment of the present invention.
Figure 23B:
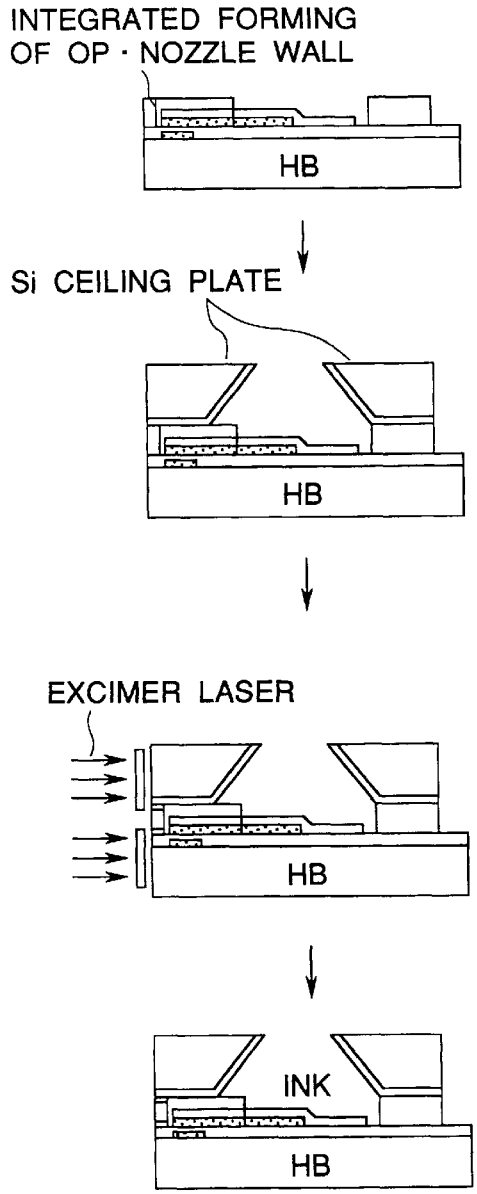

In FIGS. 23A and 23B, the cavitation proof film is formed in the same manner as described above. Then, the SiN film is formed in a thickness of 3,000 Å. The PSG film is formed by the application of plasma CVD method. The PSG film is formed on it in a thickness of approximately 5 $\mu$m. After that, by means of the known method of photolithography or the like, patterning is conducted. Then, the SiN film that becomes the movable members is formed on in a thickness of approximately 5 $\mu$m by the application of $\mu$W-CVD method. Thus, only the flow path portion is patterned in the form of comb by means of the known method of photolithography or the like. Then, on it, metallic film (not shown) that becomes etching stop layer is formed by the application of sputtering method or vacuum vapor deposition method in a thickness of 1,000 Å. Further, on it, the SiN film that becomes the orifice and nozzle members is formed by the application of $\mu$W-CVD method in a thickness of approximately 20 $\mu$m. Then, the orifice portion and the flow path portion are patterned by means of the known method of photolithography or the like, and with the metallic film which functions as the etching stop layer, the trench structure is formed by means of the etching apparatus that utilizes induction coupling plasma (ICP). After that, using TMAH, the silicon wafer penetration etching is conducted to form the silicon ceiling plate having the common liquid chamber portion on it. The ceiling plate thus formed and the portion of the trench structure is bonded at the room temperature. In this case, too, the SiN film is formed on the portion of the silicon ceiling plate which is in contact with ink. After that, the orifice portion is processed by the application of excimer laser. At this puncture, it is possible to process this portion in the inverted taper structure depending on the powers of excimer laser. Lastly, the PSG film is removed by means of wet etching method in order to form the gap between the heat generating members and the movable members where bubbles are generated initially. Now, as described above, it is possible to form with the SiN film at least the portion of the liquid discharge head which is in contact with ink in accordance with the present embodiment.

For the present embodiment, the portion which is in contact with ink is formed by the SiN film, but in place of the SiN film, it may be possible to form SiC film by the application of plasma CVD method using silane gas ($SiH_4$) and carbon gas (CnHm) as its material or it may be possible to form diamond film by the film formation executed by exciting plasma using microwave (2.45 GHz) at the substrate temperature of approximately 450° C. Furthermore, it is possible to form amorphous carbon hydrogen film by the application of CVD method by exciting plasma using RF bias of 13.56 MHz.

Figure 24:
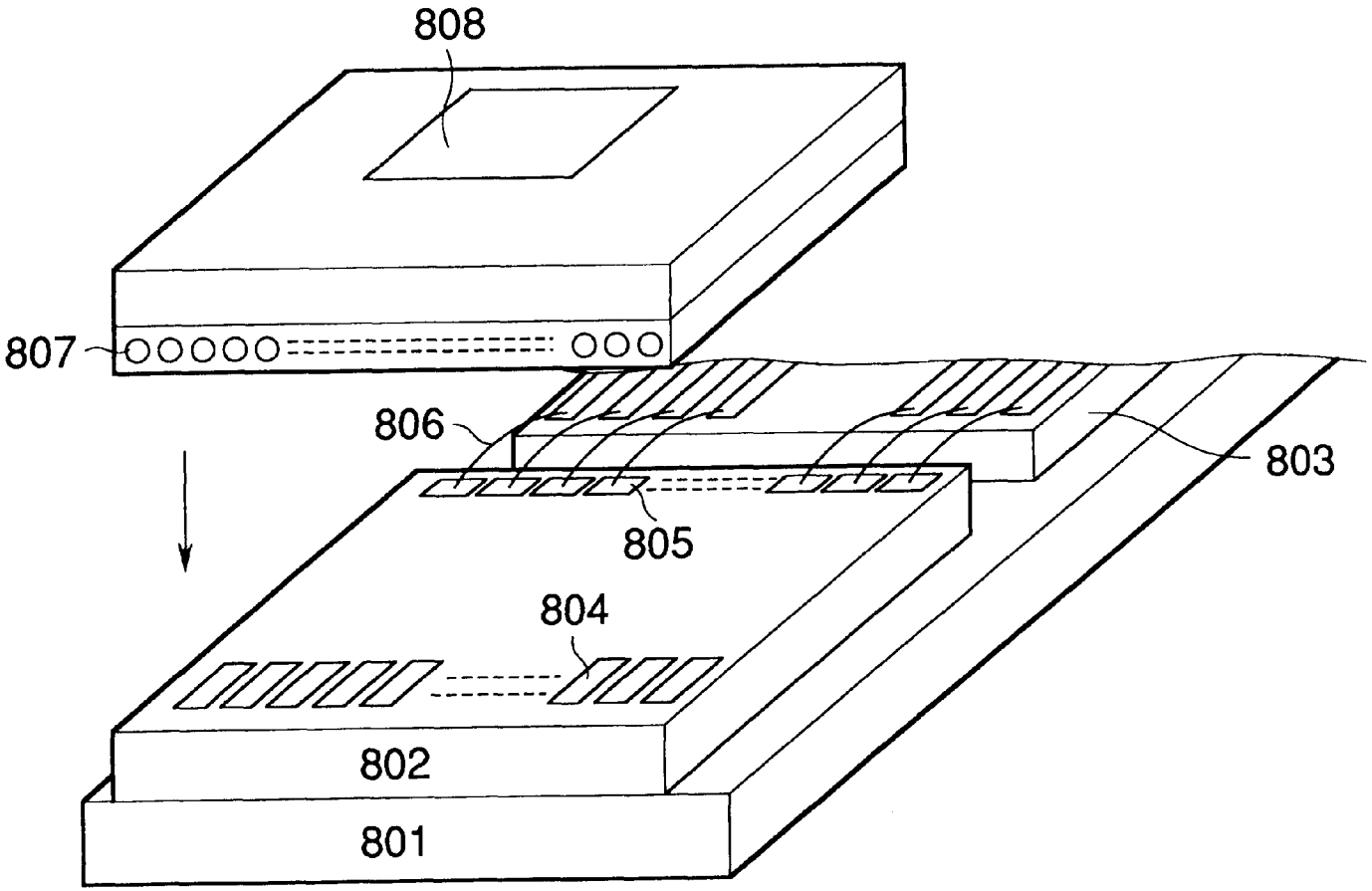
FIG. 24 is a perspective view which schematically shows the monochrome ink jet recording head using the liquid discharge head of the present invention.

FIG. 24 is a view which shows the monochrome ink jet recording head using the liquid discharge head of the present embodiment. The silicon ceiling plate formed integrally with the orifice is provided with the discharge ports 807 and the ink supply opening 808 as one body. On the base plate 801, the printed circuit board 803 is arranged for use of the external connection. The pads 805 on the heater board 802 and the printed circuit board 803 are electrically connected by means of bonding wires 806. For this recording head, it becomes possible to discharge ink from the discharge ports 807 when the heat generating members 804 are driven.

Figure 25:
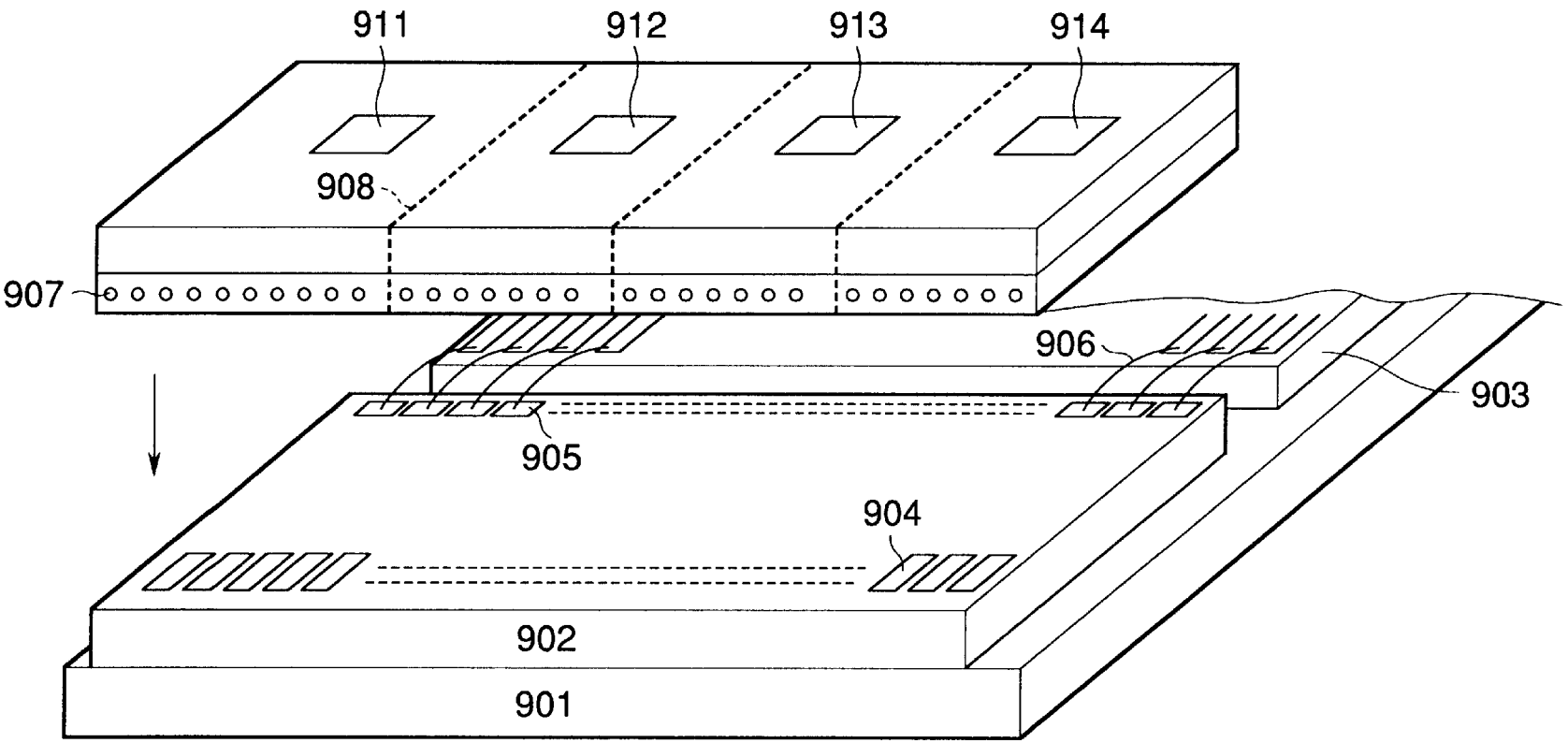
FIG. 25 is a perspective view which schematically shows the four-color integration type ink jet recording head using the liquid discharge head of the present invention.

FIG. 25 is a view which shows the four-color integrated type ink jet recording head using black, cyan, magenta, and yellow ink, for which the liquid discharge head of the present embodiment is adopted.

The silicon ceiling plate formed integrally with orifice is provided with the discharge ports 907, and also, with four ink supply openings 911, 912, 913, and 914 as one body, each corresponding to black, cyan, magenta, and yellow ink, respectively. Each of the common liquid chambers is partitioned by separation walls 908 corresponding to each color: On the base plate 901, the printed circuit board 903 is arranged for use of the external connection. The pads 905 on the heater board 902 and the printed circuit board 903 are electrically connected by means of bonding wires 906. For this recording head, it is possible to discharge multiple color ink-from the discharge ports 907 by driving heat generating members 904 which correspond to each of the colors, respectively.

Therefore, it becomes possible to perform multiple color printing with a single recording head by the adoption of the four-color integrated ink jet recording head of the present embodiment.

Further, it is possible to form the structure so that using monochrome ink and complementary liquid that stabilizes images, recording is made in more than four colors or it is possible to arrange the heat generating members in two lines, not necessarily limited only to the four-color recording.

With the ink jet recording head of the present embodiment, the discharge examination is conducted using ink having approximately 7 to 10 PH which is currently in use generally. Then, it is confirmed that the head has an extremely strong resistance to all the ink used, and that the head is apparently capable of providing recorded image in higher quality for a long time. Particularly, it is confirmed that the head produces favorable effect even when alkaline ink is used, which has been pointed out as a drawback of an ink head of the kind conventionally. Thus, it is anticipated that the ink jet head of the present invention will be adopted widely in the field where various kinds of ink are used.

(Other Embodiments)

Figure 26:
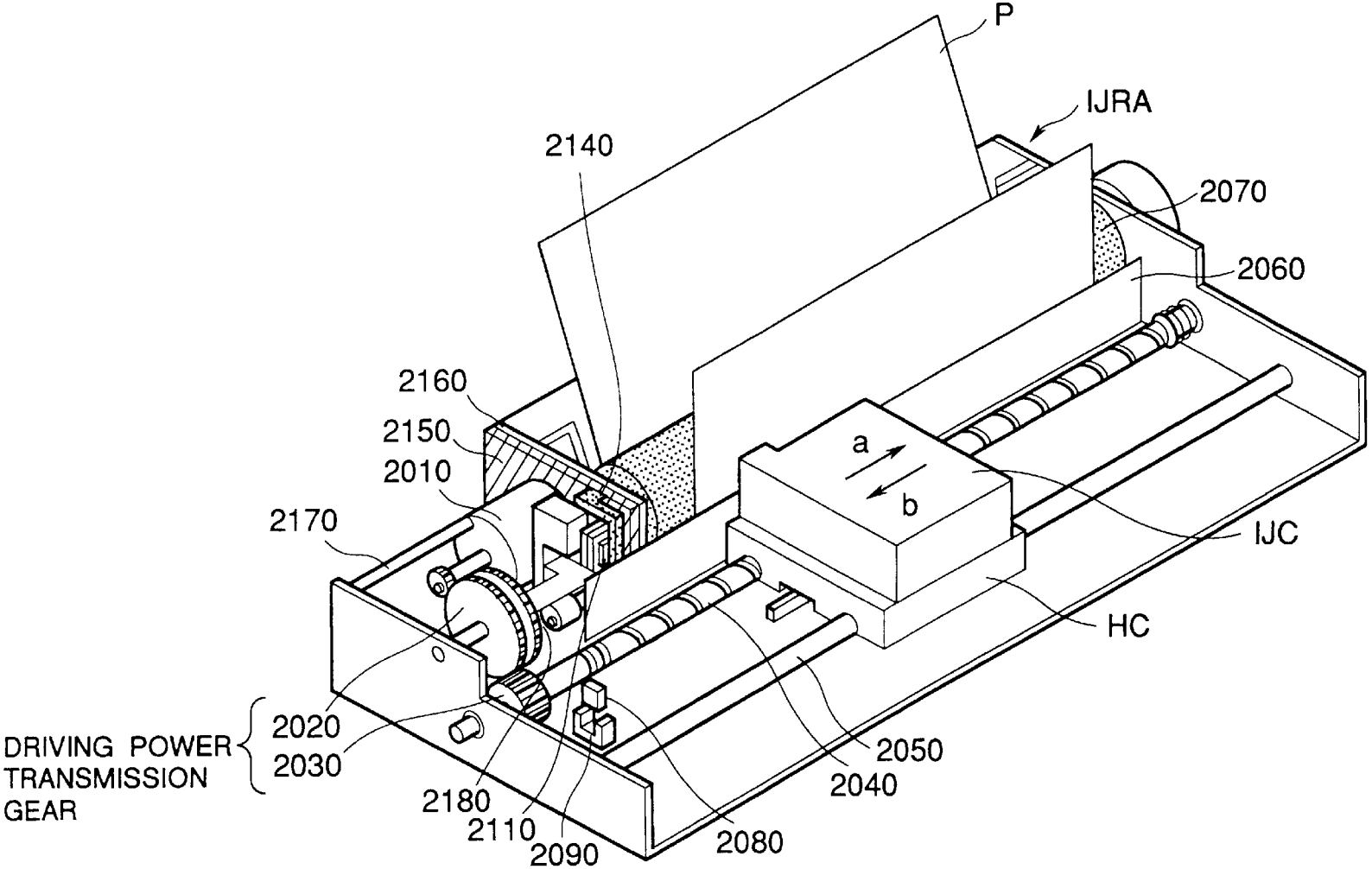
FIG. 26 is a perspective view which shows the principal part of a recording apparatus in accordance with one embodiment of the present invention.

FIG. 26 is a view which shows one example of the recording apparatus which mounts on it the liquid discharge head of the present invention as described above.

The recording apparatus IJRA is provided with the lead screw which is interlocked with the regular and reverse rotations of a driving motor 2010 for its rotation through the driving power transmission gears 2020 and 2030. The ink jet cartridge IJC, which is formed with the liquid discharge head described earlier and the ink tank integrally as one body, is mounted on the carriage HC. This carriage is supported by the carriage shaft 2050 and the lead screw 2040, and with the pin (not shown) which engages with the spiral groove of the lead screw 2040, the carriage reciprocates in the directions indicated by arrows a and b as the lead screw 2040 rotates.

The paper pressure plate 2060 presses a paper sheet P onto the platen roller 2070 in the carriage traveling direction. The photocouplers 2080 and 2090 operate as home position detecting means which detects the presence of the lever of the carriage HC within its sensing region so as to change the rotational directions of the motor 2010, among some other operations.

The capping member 2110 that caps the front end of the liquid discharge head performs the suction recovery of the liquid discharge head through the aperture in the interior of the capping member 2110. The cleaning blade 2140 that cleans the front end of the liquid discharge head is installed on the member 2150 that supported by the main body supporting member 2160 so as to be movable forward and backward and to the left- and right-hand sides. The lever 2170, which is arranged to initiate the suction recovery, is made movable along with the movement of the cam 2180 that engages with the carriage HC, and its movement is controlled by switching the driving power from the driving motor 2010 by use of the known transmission means such as clutch.

In this respect, the cleaning blade 2140 is not necessarily limited to the configuration disclosed herein. Various known cleaning blades are equally applicable to the present embodiment.

With the ink jet recording apparatus structured as described above, recording is performed, while the liquid discharge head reciprocates over the entire width of the recording sheet which is carried on the platen roller 2070.

In accordance with the embodiments of the present invention, a pair of substrates are all formed by the material that contains silicon. As a result, the thermal expansion coefficient thereof is substantially the same, and the relative positional accuracy and the close contactness between the respective members are maintained even when temperatures rises, hence making it possible to perform the stable ink discharges within a wider range of temperatures. Also, the pair of substrates are bonded at the room temperature without using any bonding agent. Thus, there is no possibility that the defective discharges are caused by the dripping of bonding agent into the liquid flow paths.

With the structure having movable members arranged in the liquid flow paths, the pressure exerted by bubbles directly contributes to performing discharges efficiently. The discharge characteristics are enhanced accordingly. Also, the efficiency of liquid refilling is improved. In this case, if the movable members are also formed by the material that contains silicon as in the case of the pair of substrates, and bonded at the room temperature, the relative positional accuracy and close contactness of the respective members are maintained, and the highly efficient printing is made executable in higher quality at the same time.

What is claimed is:

1. A liquid discharge head comprising:

a pair of substrates mutually fixed in lamination;

a plurality of liquid flow paths arranged on the bonded faces of said substrates, a leading end of said plural liquid flow paths being in communication with a plurality of discharge ports;

a plurality of heat generating members arranged on at least one of said substrates corresponding to respective ones of said liquid flow paths; and a movable member in each liquid flow path having a free end thereof on said discharge port side, and a region between said heat generating member and said movable member, where liquid exists, wherein a bubble is created by enabling thermal energy generated by said heat generating members to act upon said liquid, and said bubble being controlled by said movable member to discharge liquid in said liquid flow paths from said discharge ports to the outside, wherein said movable members and at least a portion of side wall of the liquid flow path are a same member, the portion being adjacent to the movable members, said same member being formed by laminating and patterning on one of said pair of substrates, a silicon-containing material layer becoming said movable members and said same member becoming the side wall of liquid flow paths.

2. A liquid discharge head according to claim 1, wherein said discharge ports are formed on a discharge port formation member, said discharge port formation member being formed by material containing silicon.

3. A liquid discharge head according to claim 2, wherein said discharge port formation member is formed by silicon nitride.

4. A liquid discharge head according to claim 2, wherein said discharge port formation member is a discharge port plate bonded to an end face of said pair of substrates.

5. A liquid discharge head according to claim 3, wherein said discharge port formation member is formed integrally with said liquid flow path side walls.

6. A liquid discharge head according to claim 1, wherein said movable members and liquid flow path side walls are formed by silicon nitride.

7. A liquid discharge head according to claim 1, wherein said bubble is created by means of a film boiling phenomenon generated in the liquid by the heating of said heat generating members.

8. A liquid discharge head according to claim 1, wherein said pair of substrates are structured by members having silicon as their main component and a nitrogen compound or a carbon compound is formed on portions of said pair of substrates that are in contact with liquid.

9. A liquid discharge head according to claim 8, wherein said nitrogen compound is composed of SiN.

10. A liquid discharge head according to claim 8, wherein said carbon compound is formed by either SiC film, diamond film, or amorphous carbon hydride film.

11. A liquid discharge head according to claim 1, wherein said pair of substrates are structured by members having silicon as their main component and a nitrogen compound or a carbon compound is formed on portions of said pair of substrates other than a portion on which Ta film is formed.

12. A liquid discharge head according to claim 11, wherein said nitrogen compound is composed of SiN.

13. A liquid discharge head according to claim 11, wherein said carbon compound is formed by either SiC film, diamond film, or amorphous carbon hydride film.

14. A liquid discharge head according to claim 1, further comprising:

a plurality of heater drivers formed on the surface of the substrate on which said heat generating members are arranged, corresponding to respective ones of said plural heat generating members to drive each of them, respectively.

15. A liquid discharge head according to claim 14, wherein said plurality of heater drivers are arranged in line in the direction parallel to the arrangement direction of said plurality of heat generating members.

16. A liquid discharge head according to claim 15, wherein each of said heater drivers can withstand a voltage of 10 to 50 V during use and each of said heat generating members has a sheet resistance of 50 Ω/□ or more during use.

17. A liquid discharge head according to claim 16, wherein either offset MOS, LDMOS or LVMOS type transistors are used for said heater drivers and TaSiN is used as a material of said heat generating members.

18. A liquid discharge-head according to claim 14, wherein the substrate having said heat generating members is provided with a protection film protecting said heat generating members and heater drivers and said protection film is a nitrogen compound or a carbon compound.

19. A liquid discharge head according to claim 18, wherein said nitrogen compound is SiN.

20. A liquid discharge head according to claim 18, said carbon compound is either SiC film, diamond film, or amorphous carbon hydride film.

21. A liquid discharge head according to claim 1, wherein said pair of substrates are fixed by means of the surface activation bonding at the room temperature.

22. A head cartridge comprising:

a liquid discharge head according to any one of claims 1 and 2–21; and a liquid container retaining liquid to be supplied to said liquid discharge head.

23. A liquid discharge apparatus comprising:

a liquid discharge head according to any one of claims 1 and 2–21; and driving signal supplying means for supplying a driving signal for discharging liquid from said liquid discharge head.

24. A liquid discharge apparatus comprising:

a liquid discharge head according to any one of claims 1 and 2–21; and recording medium carrier means for carrying a recording medium receiving liquid discharged from said liquid discharge head.

* * * * *

UNITED STATES PATENT AND TRADEMARK OFFICE

CERTIFICATE OF CORRECTION

PATENT NO. : 6,485,132 B1
DATED : November 26, 2002
INVENTOR(S) : Tomoyuki Hiroki et al.

It is certified that error appears in the above-identified patent and that said Letters Patent is hereby corrected as shown below:

Column 1,
Line 31, “head is” should read -- head --.

Column 5,
Lines 42 and 49, “up to the” should read -- up to the point where the --.

Column 6,
Line 54, “um” should read -- μm --; and
Line 57, “In stead” should read -- Instead --.

Column 7,
Line 24, “fee” should read -- free --;
Line 51, “6” should read -- 2, and --; and
Line 58, “bubble” should read -- a bubble --.

Column 10,
Line 22, “um” should read -- μm --.

Column 11,
Lines 22, 24, 27 and 32, “um” should read -- μm --;
Lines 33, 35 and 36, “um” should read -- μm --;
Line 37, “us,” should read -- μs, --; and
Line 50, “n/0” should read -- Ω/□ --.

Column 12,
Line 1, “um” should read -- μm --.

Column 15,
Line 12, “the” should be deleted; and
Line 42, “hated,” should read -- hand, --.

Column 18,
Line 14, “beings” should read -- begins --.

Column 23,
Line 36, “said” should read -- the --; and
Line 57, “claim 3,” should read -- claim 2, --.

UNITED STATES PATENT AND TRADEMARK OFFICE

CERTIFICATE OF CORRECTION

PATENT NO. : 6,485,132 B1
DATED : November 26, 2002
INVENTOR(S) : Tomoyuki Hiroki et al.

It is certified that error appears in the above-identified patent and that said Letters Patent is hereby corrected as shown below:

Column 24,
Lines 49, 54 and 60, “claims 1” should read -- claims 1 to 21; --; and
Lines 50, 55 and 61, “and 2-21;” should be deleted.

Signed and Sealed this

Twenty-seventh Day of January, 2004

JON W. DUDAS
*Acting Director of the United States Patent and Trademark Office*